US009441352B2

(12) United States Patent
Bilal

(10) Patent No.: US 9,441,352 B2
(45) Date of Patent: Sep. 13, 2016

(54) STATIC LOCKING APPARATUS FOR ROTATABLE CONNECTOR PIN ASSEMBLY

(71) Applicant: Hensley Industries, Inc., Dallas, TX (US)

(72) Inventor: Mohamad Y. Bilal, Little Elm, TX (US)

(73) Assignee: Hensley Industries, Inc., Dallas, TX (US)

( * ) Notice: Subject to any disclaimer, the term of this patent is extended or adjusted under 35 U.S.C. 154(b) by 38 days.

(21) Appl. No.: 14/512,798

(22) Filed: Oct. 13, 2014

(65) Prior Publication Data

US 2015/0113839 A1 Apr. 30, 2015

Related U.S. Application Data

(60) Provisional application No. 61/897,675, filed on Oct. 30, 2013.

(51) Int. Cl.
*E02F 9/28* (2006.01)

(52) U.S. Cl.
CPC ..... *E02F 9/2841* (2013.01); *E02F 9/2825* (2013.01)

(58) Field of Classification Search
CPC ... E02F 9/2833; E02F 9/2825; E02F 9/2883; E02F 9/2841; F16B 21/12; F16B 19/02
USPC ..... 37/466, 452–456; 172/722, 172/701.1–701.3; 403/320, 376
See application file for complete search history.

(56) References Cited

U.S. PATENT DOCUMENTS

| | | | |
|---|---|---|---|
| 6,393,739 | B1 | 5/2002 | Shamblin et al. |
| 6,708,431 | B2 | 3/2004 | Robinson et al. |
| 6,799,386 | B2 | 10/2004 | Robinson et al. |
| 6,826,855 | B2 | 12/2004 | Ruvang |
| 6,976,325 | B2 | 12/2005 | Robinson et al. |
| 7,121,023 | B2 | 10/2006 | Robinson et al. |
| 7,162,818 | B2 | 1/2007 | Ruvang et al. |
| 7,681,341 | B2 | 3/2010 | Ruvang |
| 7,862,277 | B2 | 1/2011 | Dingwall et al. |
| 2006/0037219 | A1 | 2/2006 | Robinson et al. |
| 2012/0055052 | A1 | 3/2012 | Campomanes et al. |

OTHER PUBLICATIONS

International Search Report and Written Opinion issued for PCT/US2014/060381, dated Mar. 6, 2015, 12 pgs.

*Primary Examiner* — Robert Pezzuto
(74) *Attorney, Agent, or Firm* — Haynes & Boone, LLP

(57) ABSTRACT

A ground engaging wear member is telescoped onto and releasably retained on a support member by a connector pin assembly extending through aligned openings in the wear and support members. A pin portion of the assembly is rotatable relative to the wear and support members between locking and unlocking positions in which opposite end tabs of the pin respectively block and unblock removal of the wear member from the support member. A drive bolt is threaded into an end or the pin and is connected to locking structure within the pin. Rotation of the bolt in one direction rotates the pin to and statically locks it in its locking position, while rotation of the bolt in the opposite direction rotates the pin to and statically locks it in its unlocking position.

26 Claims, 24 Drawing Sheets

STATIC LOCKING APPARATUS FOR ROTATABLE CONNECTOR PIN ASSEMBLY

CROSS-REFERENCE TO RELATED APPLICATION

The present application claims the benefit of the filing date of provisional U.S. patent application No. 61/897,675 filed Oct. 30, 2013. The entire disclosure of the provisional application is hereby incorporated herein by this reference.

BACKGROUND OF THE INVENTION

The present invention relates generally to ground engaging apparatus and more particularly is directed to a connector pin assembly used to captively and releasably retain a replaceable ground engaging wear member on a support member on which the wear member is telescoped.

In the ground engaging apparatus shown in FIGS. 1-7 of U.S. Pat. No. 6,976,325, which is hereby incorporated herein by reference, a rotatable connector pin assembly is used to releasably join telescoped ground-engaging members, such as an adapter and tooth point, and includes telescoped pin and tubular cartridge portions. To use the assembly, the telescoped pin and cartridge portions are inserted into aligned openings in the adapter and tooth point. The cartridge has a non-circular cross-section along its length and is complementarily received in the non-circular adapter connector opening. This keeps the cartridge from rotating relative to the adapter and tooth point, but the pin can be rotated within the cartridge between unlocking and locking positions rotationally separated, representatively, by approximately 120 degrees.

With the pin in its locking position, end tabs or "ears" on the pin block removal of the tooth point from the adapter. However, with the pin rotated to its unlocking position relative to the cartridge, the tabs unblock the tooth point and permit it to slide onto or off of the adapter, the tabs moving through opposite interior side surface recesses of the tooth point as it is moved onto or off of the adapter. Resilient detent structures on the pin operative to resiliently and releasably hold the pin in either one of its locking and unlocking positions.

In using this connector pin assembly it has been discovered that in some applications the pin, when subjected to certain operational forces, may be rotationally dislodged from its locking position to its unlocking position, thereby permitting the tooth point to fall off the adapter. A need thus exists to for an improved connector pin assembly that substantially eliminates this potential wear member dislodgment problem. It is to this need that the present invention is primarily directed.

DETAILED DESCRIPTION

Figure 1:
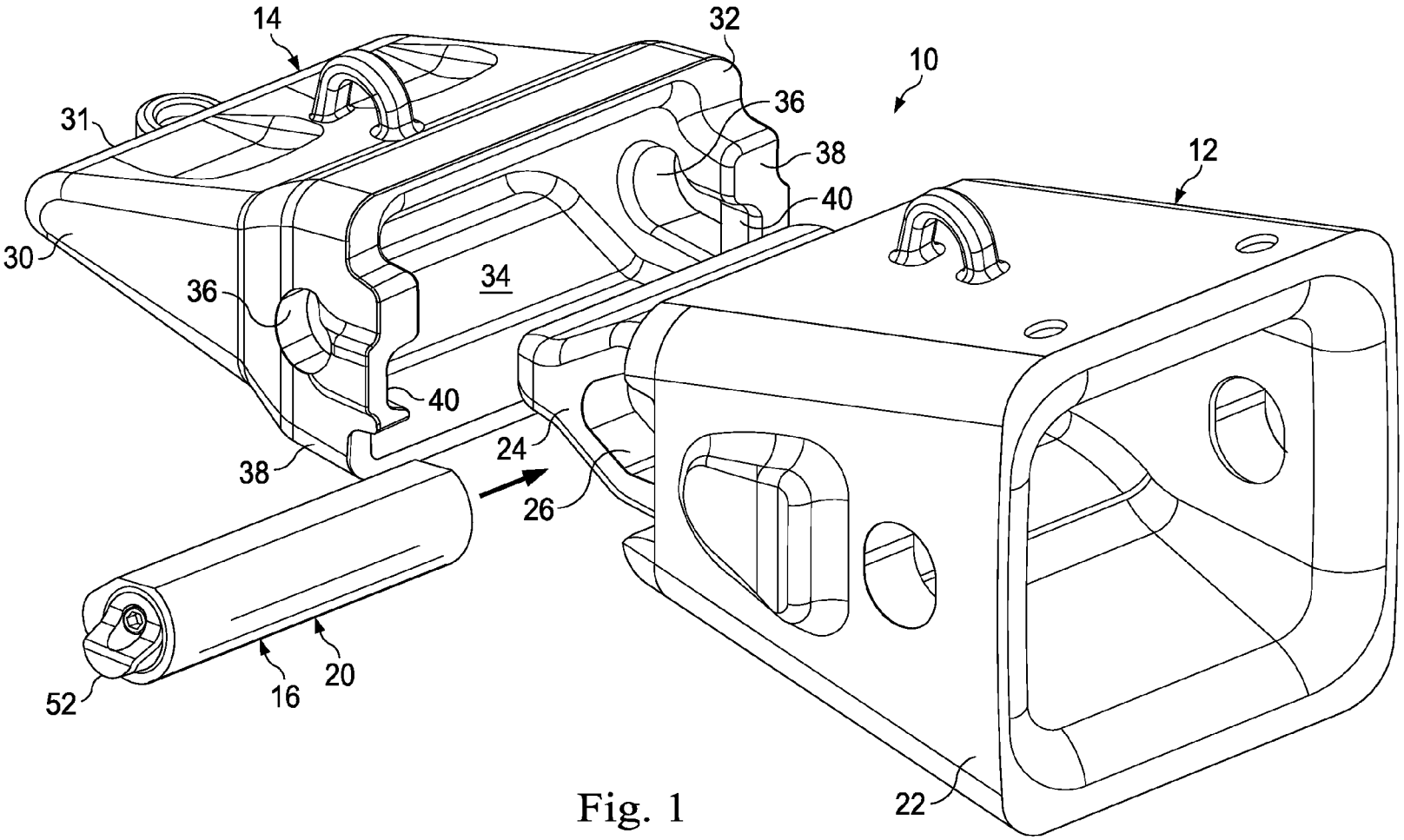
FIG. 1 is an exploded perspective view of a ground engaging assembly comprising a support member, a wear member telescopable onto the support member, and a specially designed rotatable connector pin assembly embodying principles of the present invention and useable to releasably retain the wear member on the support member.

In an exemplary embodiment thereof, the present invention, in a simple and inexpensive manner, provides a specially designed static pin member rotational locking apparatus that rigidly blocks such undesired rotational shifting of the pin away from its locked orientation relative to its associated cartridge, thereby statically locking the pin to the cartridge in a selectively releasable manner. Such exemplary embodiment of the present invention will now be described in conjunction with FIGS. 1-32 of this application.

With initial reference to FIGS. 1-5, the present invention provides an excavating tooth assembly 10 (FIGS. 1 and 5) including a support structure representatively in the form of an adapter 12, a wear member representatively in the form of a replaceable tooth point 14, and a rotatable connector pin assembly 16 (FIGS. 2-4) having a pin portion 18 coaxially and rotatably received in a tubular hollow body or cartridge portion 20. As will be later described herein, the rotatable connector pin assembly 16 is provided with a specially designed locking system which permits the pin 18 to be rigidly or "statically" locked relative to the cartridge 20 in either a locking orientation or an unlocking orientation rotationally offset from the locking orientation, and to be selectively released from either such rotational orientation for rotational movement to the other rotational orientation.

Adapter 12 has a rear base portion 22 from which a nose portion 24 forwardly projects, the nose portion 24 having a non-circular transverse connector opening 26 extending horizontally therethrough between the opposite vertical sides of the nose 24. The replaceable point 14 has a front end 30 on which a suitable leading edge 31 is disposed, a rear end 32 through which a nose-receiving socket 34 forwardly extends, and a horizontally opposed pair of connector openings 36 extending inwardly through thickened external boss portions 38 into the interior of the socket 34.

The interior surface of the socket 34 has a configuration substantially complementary to the external surface of the adapter nose 24. A horizontally opposed pair of generally rectangular recesses 40 are formed in interior vertical side wall surface portions of the bosses 38 and extend forwardly through the rear end 32 of the point 14. Each of these recesses 40 has a height less than the heights of the point side wall openings 36, and forwardly terminates at a bottom portion of one of such openings 36. Thus, each recess 40 has a front or inner end portion which is defined by a side surface of an associated opening 36 and is enlarged relative to a rear or outer end portion of the recess 40 in a direction parallel to the inner side surface of the tooth point side wall in which the recess 40 is formed.

Turning now to FIGS. 2-4 and 6-7A, the tubular cartridge 20 has a non-circular cross-section along its length and is provided with a longitudinally extending transverse external lobe section 42. The cross-section of the cartridge 20 is complementary to that of the adapter nose connector opening 26 so that when the connector pin assembly 16 is inserted into the connector opening 26 as later described herein, the cartridge 20 is precluded from rotating within the connector opening 26. The interior passage 44 of the cartridge 20 opens outwardly through the opposite ends of the cartridge 20 and has a circular cross-section along its length.

The pin member 18 (FIGS. 6, 6A, 7 and 7*a*) has a circular cross-section along its length, and enlarged diameter end portions 46 and 48 respectively having longitudinally outwardly projecting end tabs or "ears" 50 and 52. Each tab 50,52 has a curved, radially outwardly facing surface 54 defining an extension of the outer side surface of its adjacent enlarged diameter end portion of the pin member 18, and an opposite, chordwise-extending flat surface 56. An axially extending recess 58 extends inwardly through the outer end of the end portion 48, with an internally threaded axial bore 60 (see FIG. 7A) extending inwardly through the end portion 48 within the periphery of the recess 58. Bore 60 opens into a side recess area 62 formed in the pin member 18 adjacent the end portion 48 and communicating with the inner end of the bore 60. Recess 62 has axially spaced apart abutment surfaces 64,66 and a generally V-shaped interior surface recess 68 (see FIGS. 7 and 19) laterally opposite the abutment surfaces 64,66. Spaced axially from the recess 62 toward the pin member end portion 46 is an external surface groove 70 circumferentially extending through a predetermined angle, representatively 120 degrees, around the pin body. Pin 18 is sized to be rotatably received within the interior of the cartridge 20, with the enlarged pin end portions slidably contacting the interior surface of the cartridge 20 and the pin tabs 50,52 projecting outwardly from the pin end portions 46,48 (see FIG. 2). Annular O-ring seals 72 (FIG. 7) are provided for sealing the ends of the cartridge-inserted pin member 18.

Figure 6A:
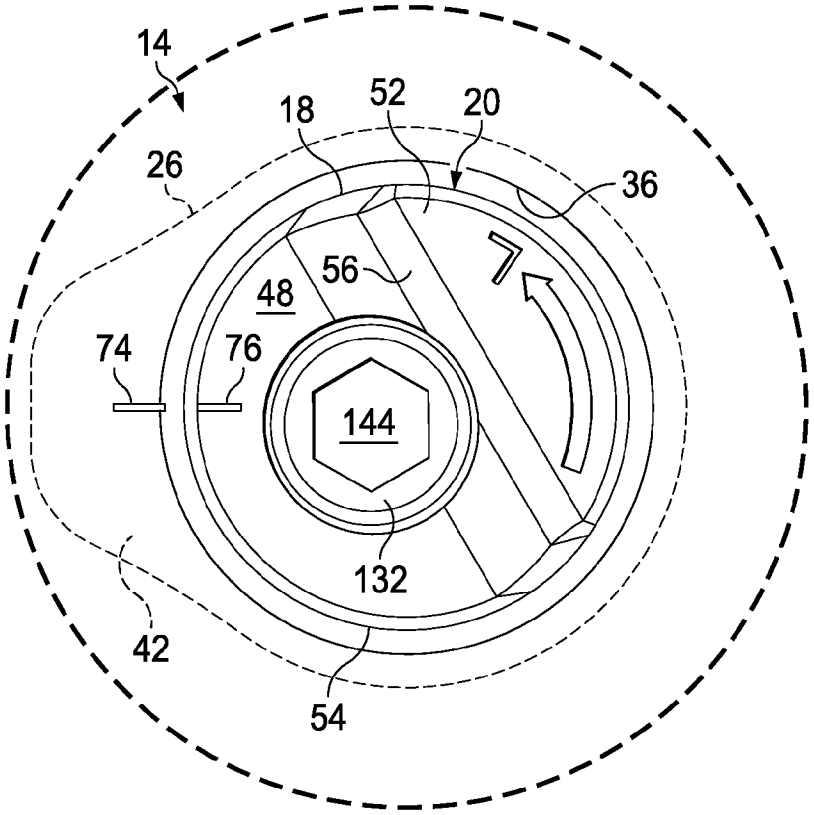
FIGS. 6 and 6A are enlarged scale partially phantomed side elevational views of the dashed area "6" in FIG. 5 and respectively depict the rotatable connector pin assembly in unlocked and locked orientations thereof.
Figure 6:
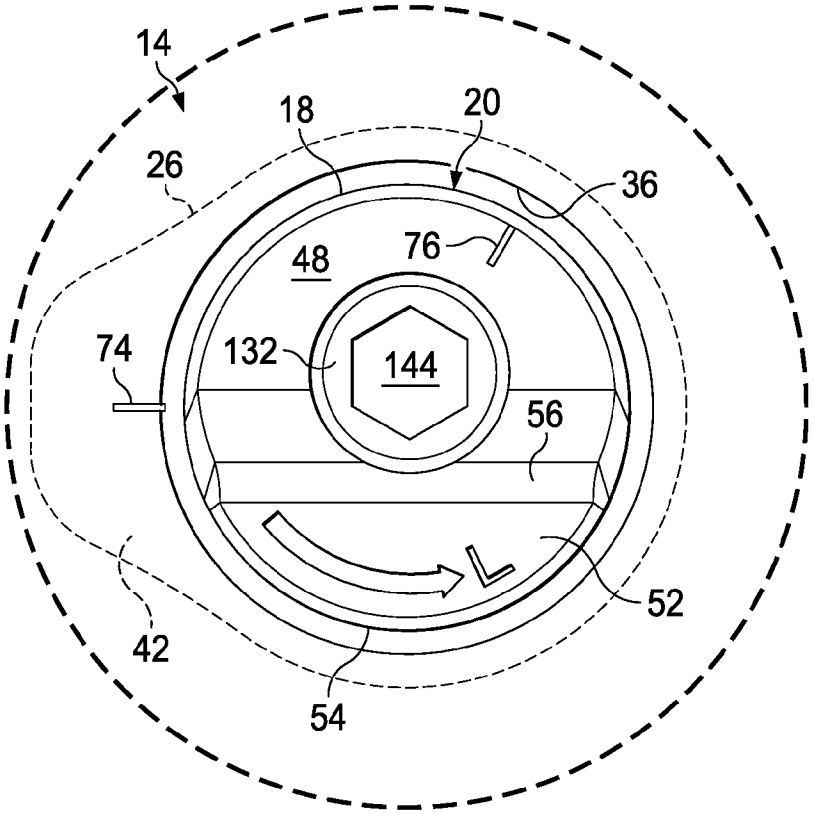

As shown in FIGS. 6 and 6A, with the pin 18 operatively inserted into the cartridge 20, the pin 18 may be selectively rotated between (1) an unlocked position (FIG. 6) in which alignment marks 74,76 respectively formed on the cartridge 20 and the pin end 48 are rotationally separated by a predetermined angle (representatively 120 degrees), and (2) a locked position (FIG. 6A) in which the marks 74,76 are rotationally aligned.

Figure 7:
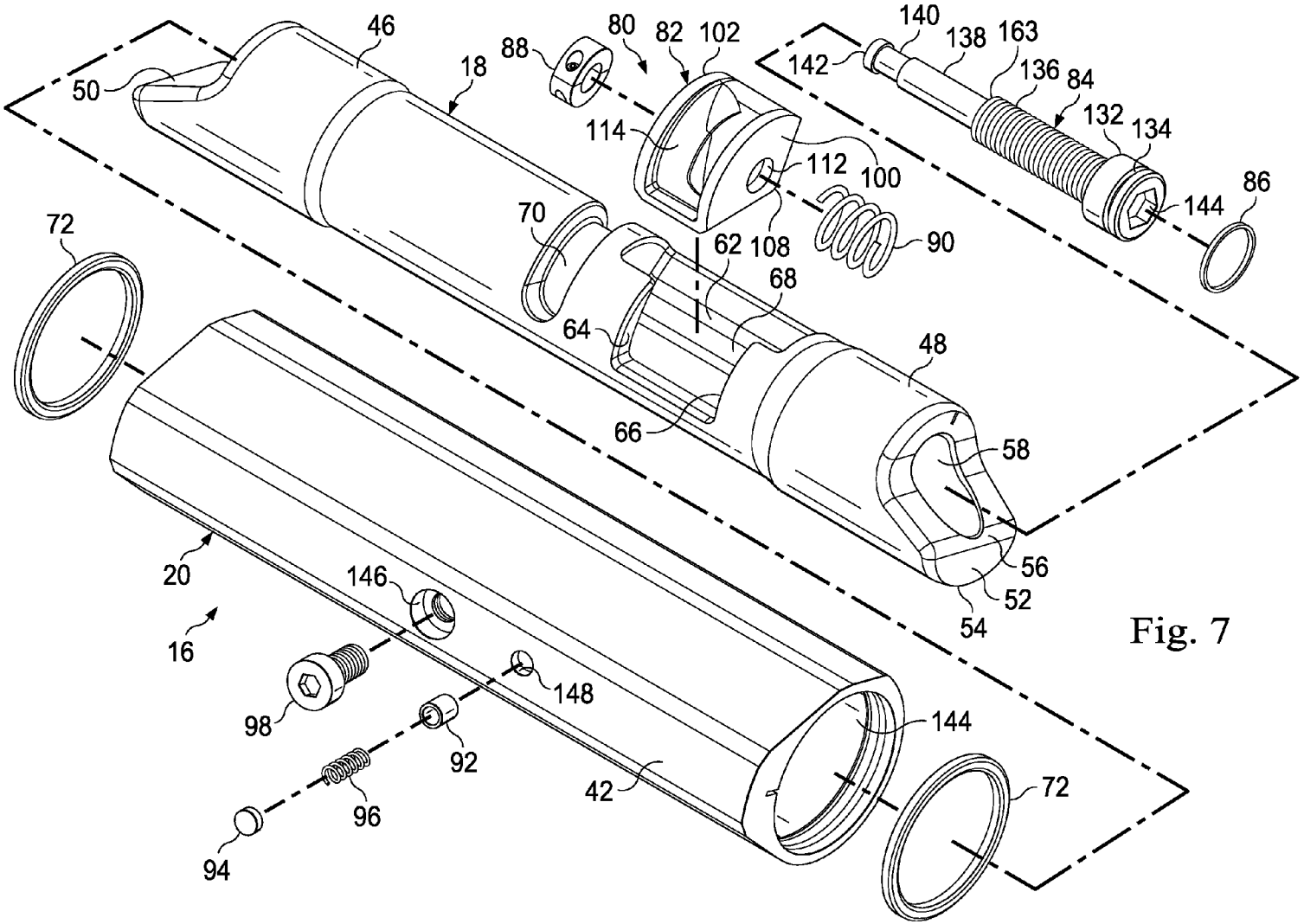
FIG. 7 is an enlarged scale exploded perspective view of the rotatable connector pin assembly.

According to a feature of the present invention a specially designed locking system is provided for rigidly or "statically" locking the pin 18 in a selectively variable one of these positions relative to the cartridge 20. The locking system, generally denoted by the reference numeral 80, is depicted in FIGS. 7-8C and includes (1) a lock plate structure 82; (2) a drive member in the form of a central drive bolt 84 and associated O-ring seal 86; (3) a diametrically split shaft collar 88; (4) a central spring 90; (5) a lock shaft 92; (6) a set screw 94; (7) a lock spring 96; and (8) a dead bolt 98. In some embodiments, a set of nuts may be used in place of the diametrically split shaft collar 88.

The lock plate structure 82 (see FIGS. 8A-8C) has spaced apart opposite side walls 100,102 joined by angled bottom and rear walls 104,106 having a generally V-shaped juncture area 108 therebetween, and a recessed solid central portion 110. A circularly cross-sectioned bore 112 extends through the central portion 110 and opens outwardly through the side walls 100,102. Disposed within the recessed portion of the lock plate structure 82 between its side walls 100,102 is a ramped, generally rectangular track area 114 having, in sequence in a clockwise direction as viewed in FIG. 8A, track sections 114*a*, 114*b*, 114*c* and 114*d*.

Figure 8A:
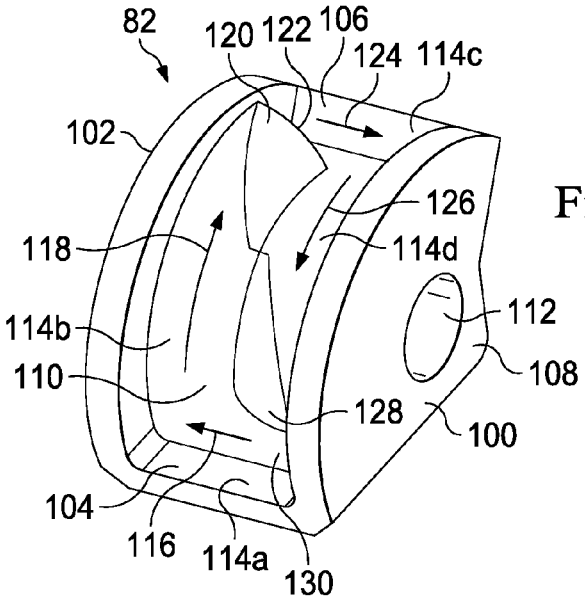
FIGS. 8A-8C are differently oriented enlarged scale perspective views of a locking plate structure utilized in the rotatable connector pin assembly.
Figure 8B:
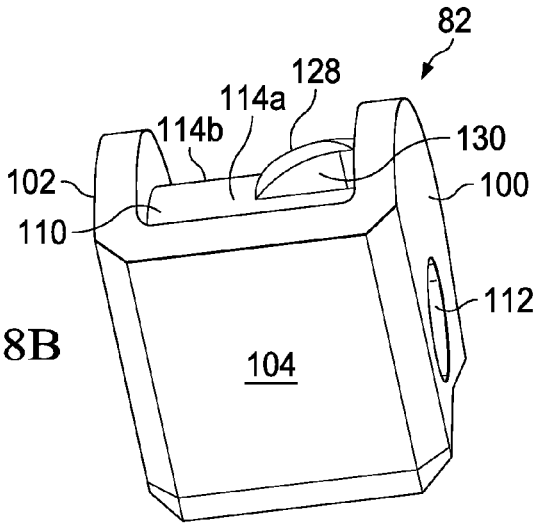
Figure 8C:
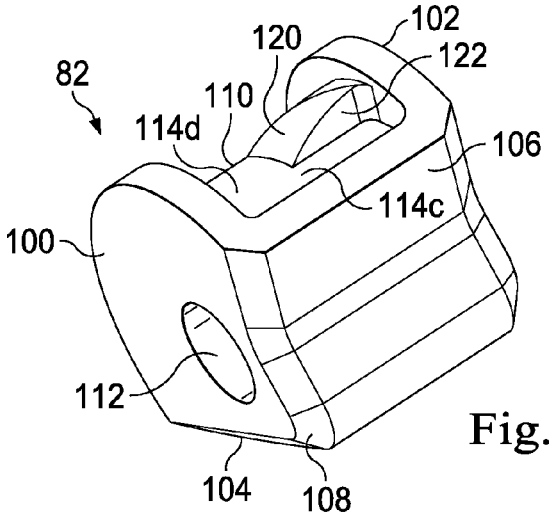

Track section 114*a* extends from the side wall 100 to the side wall 102 along the bottom wall 104 (see arrow 116 in FIG. 8A). Track section 114*b* then extends from track section 114*a* along the side wall 102 (arrow 118), upwardly over a track ramp 120, and then drops into track section 114*c*, the ramp 120 having an abutment surface 122 that faces and is spaced apart from the rear wall 106. From the abutment 122, track section 114*c* extends (as indicated by arrow 124 in FIG. 8A) to the side wall 100. From its juncture with the track section 114*c*, the final track section 114*d* extends along the side wall 100 (arrow 126), upwardly over a second track ramp 128, and then drops into an initial portion of the track section 114*a*, the ramp 128 having an abutment surface 130 that faces and is spaced apart from the bottom wall 104.

The central drive bolt 84 (FIGS. 7 and 7A) has, from right to left as viewed in FIG. 7, a head portion 132 with an annular groove 134 that receives the O-ring seal 86, a threaded portion 136, and a non-threaded portion 138 having a reduced diameter section 140 spaced inwardly from its inner (left) end 142. A non-circular drive recess 144 is formed in the outer end of the bolt head portion 132.

Figure 14:
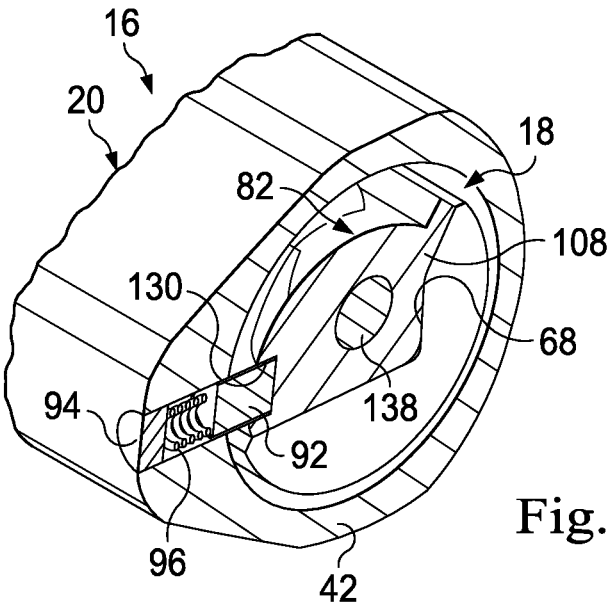
Figure 15:
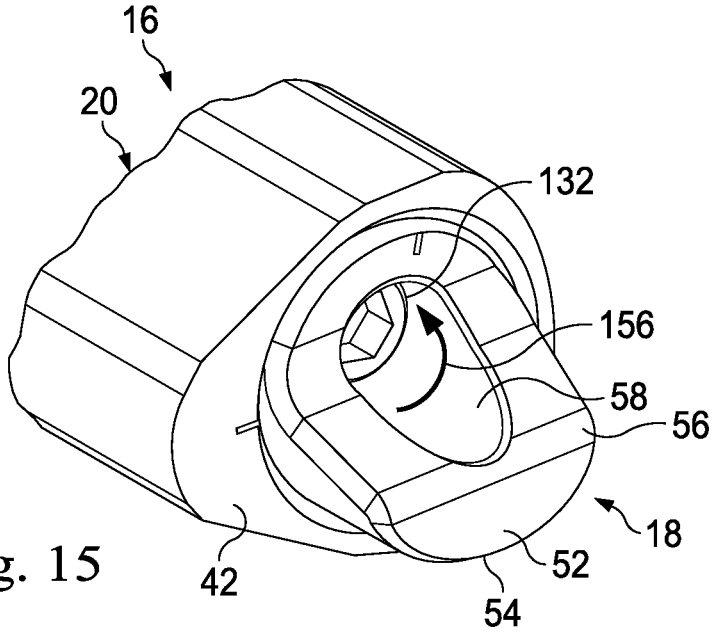
Figure 16:
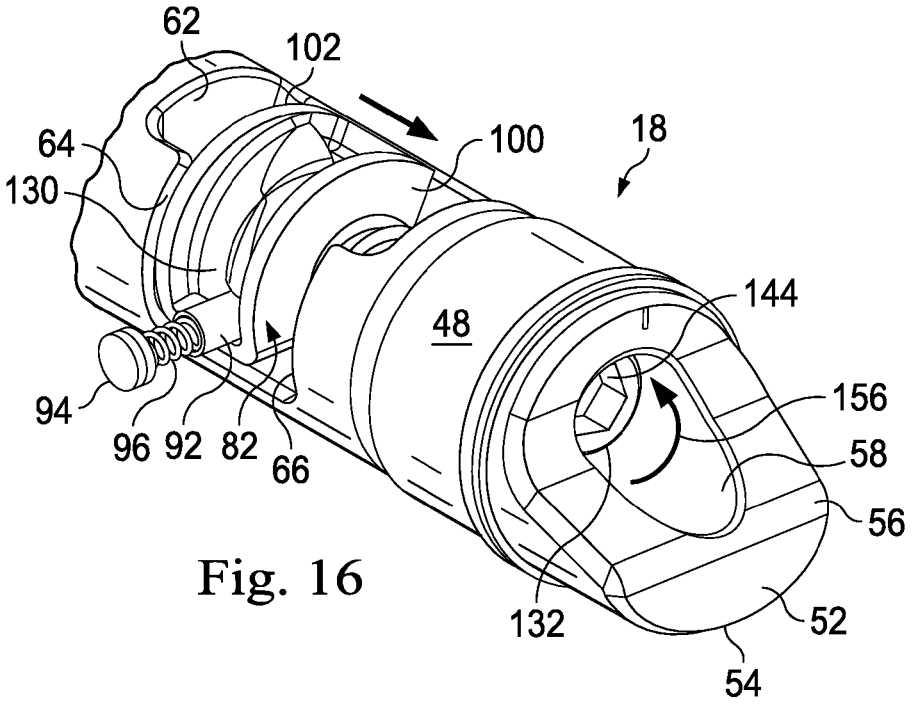

To construct the rotatable connector pin assembly 16, the lock plate structure 82 is inserted into the side recess area 62 of the pin 18 with the lock plate side wall 100 facing the pin end 48 and the V-shaped juncture portion 108 of the lock plate structure 82 complementarily received in the V-shaped interior surface recess 68 of the pin 18 (see FIG. 14). Bolt 84 is then inserted through and threaded into the threaded bore 60 of pin end portion 48. This causes the non-threaded bolt portion 138 to enter the pin side recess area 62. As it enters the recess area 62, it is extended sequentially through the central spring 90 and the lock plate structure bore 112 so that the reduced diameter bolt section 140 extends outwardly past the lock plate structure side wall 102. The shaft collar 88, which is of a two piece construction, is then installed on the inner end of the bolt 84 so that it enters into the reduced diameter portion 140 thereof, thereby blocking movement of the bolt end portion 142 rightwardly through the lock plate structure 82 as viewed in FIG. 7A. With the lock plate structure 82 in place within the pin side recess area 62, due to the complementary interfit between the pin recess 68 and the lock plate structure junction area 108, the lock plate structure 82 may axially translate within the recess area 62, but cannot rotate relative to the pin 18 about its longitudinal axis. In some embodiments, as will be described in further detail below with the text accompanying FIG. 33, a set of nuts may be used in place of the shaft collar 88.

Figure 2:
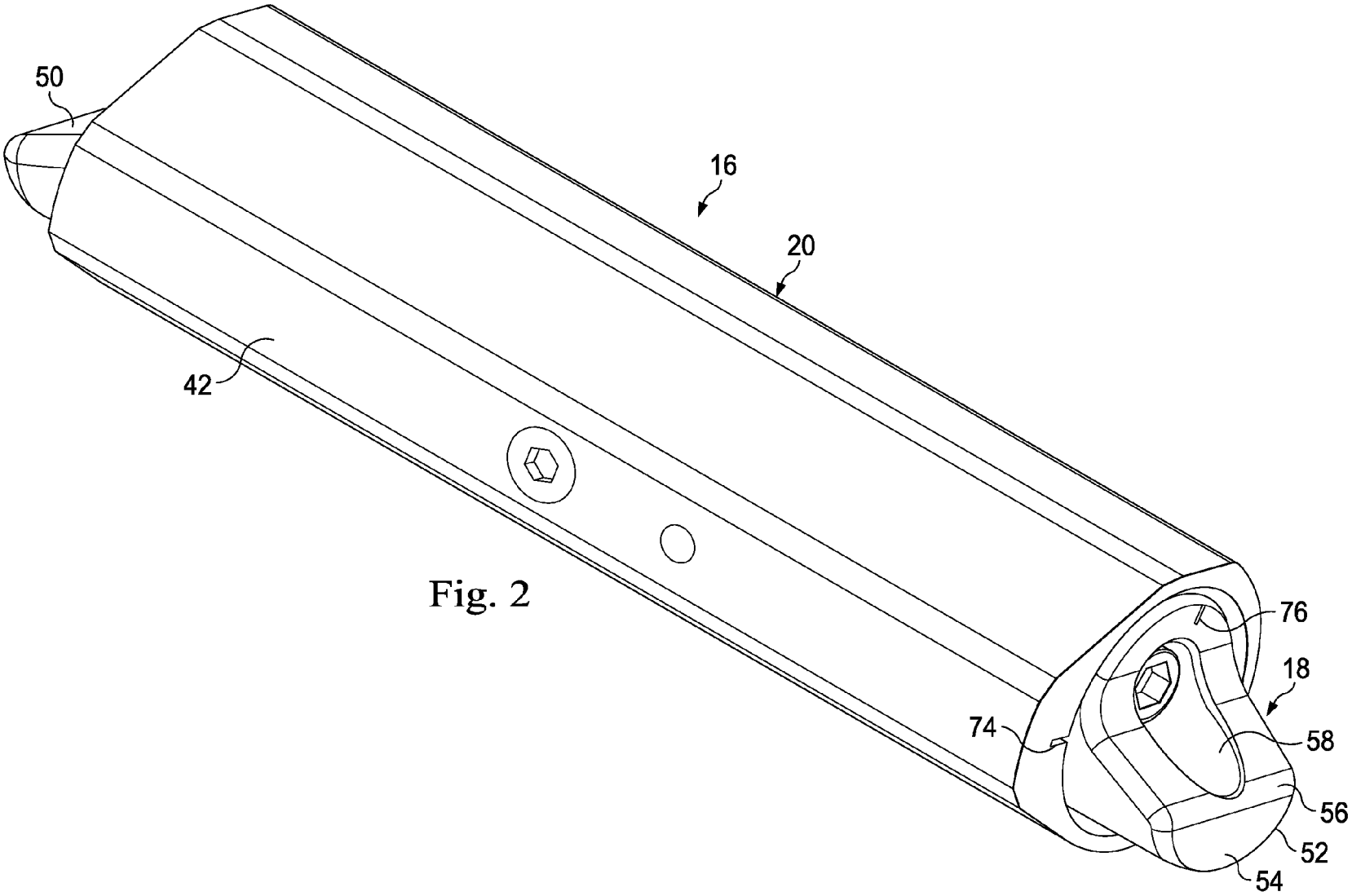
FIG. 2 is an enlarged scale perspective view of the rotatable connector pin assembly.
Figure 3:
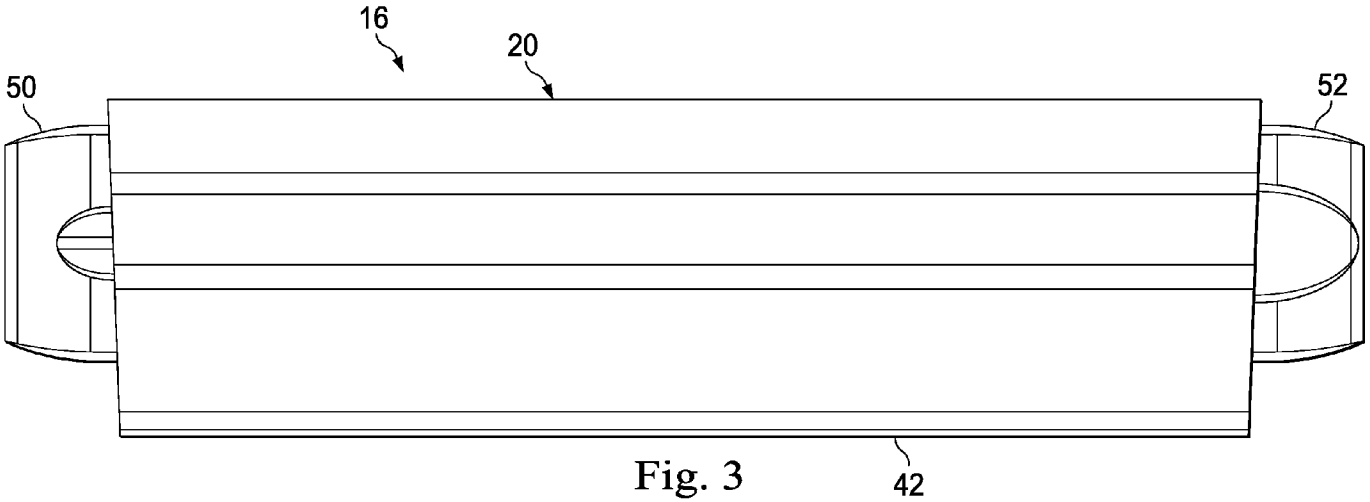
FIG. 3 is a reduced scale top plan view of the FIG. 2 rotatable connector pin assembly.
Figure 4:
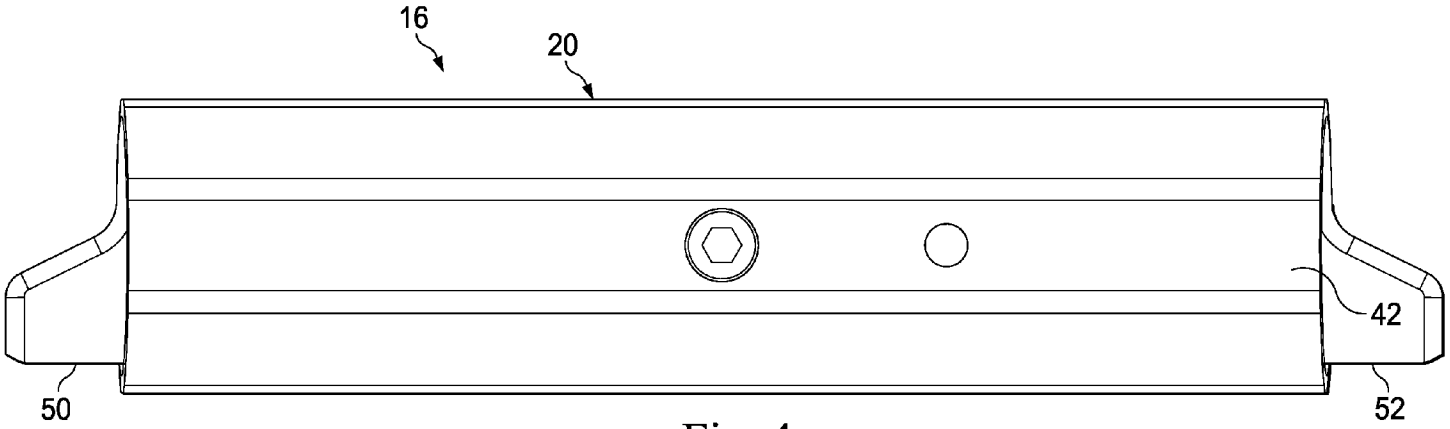
FIG. 4 is a reduced scale side elevational view of the FIG. 2 rotatable connector pin assembly.
Figure 5:
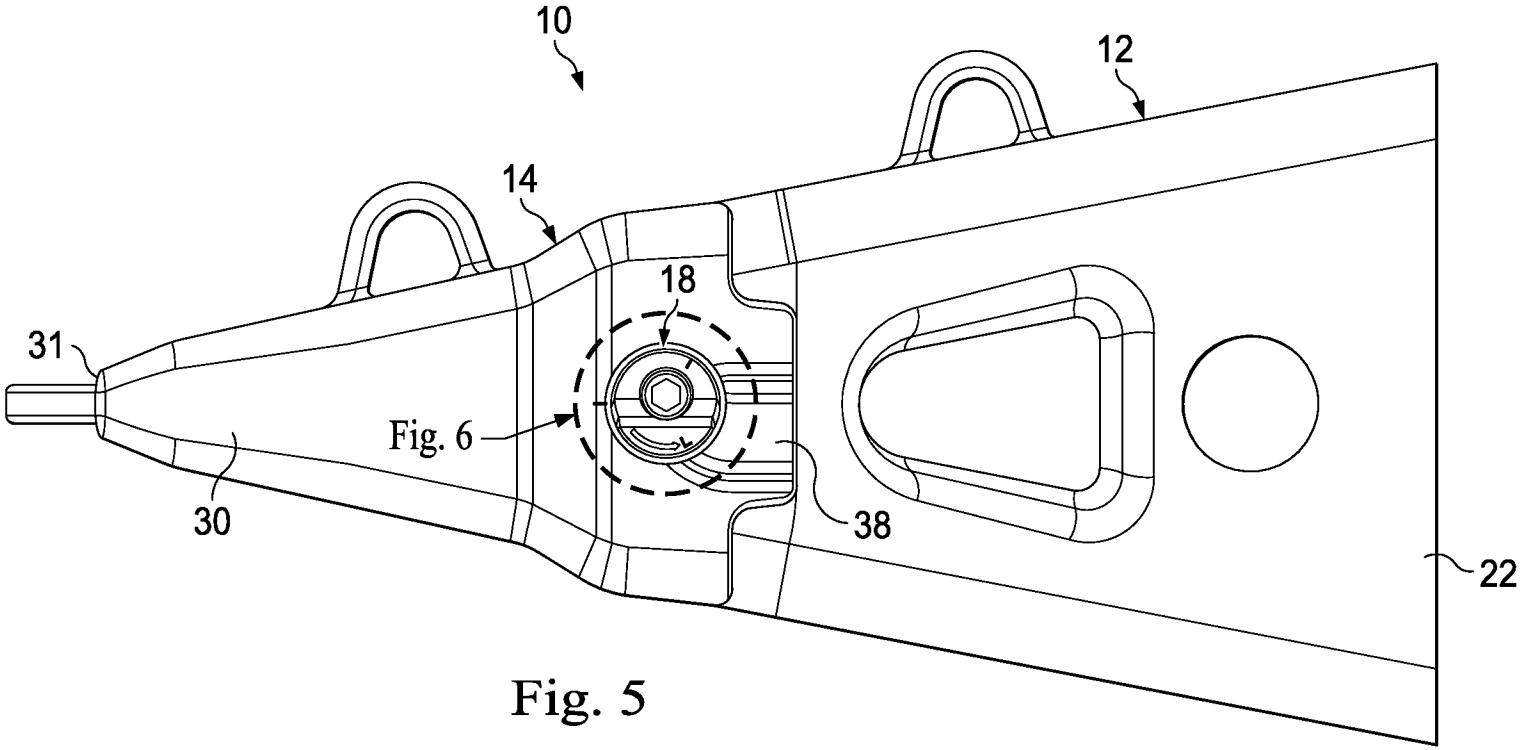
FIG. 5 is an assembled side elevational view of the FIG. 1 ground engaging assembly.

After these locking system components are operatively placed on the pin 18, the pin 18 is inserted into the cartridge 20 and secured therein using the other locking system components 92,94,96,98. Specifically, when the pin 18 is inserted into the cartridge 20, the dead bolt 98 is threaded into an opening 146 (see FIG. 7) formed through the cartridge lobe section 42 and enters the previously mentioned external pin surface groove 70. The installed dead bolt 98 maintains the desired axial relationship of the telescoped pin 18 and cartridge 20 such that the pin tabs 50,52 project outwardly through the opposite ends of the cartridge 20 as shown in FIG. 2, and further limits the rotation of the pin 18 relative to the cartridge to the predetermined value (representatively 120 degrees between the locking and unlocking positions of the pin 18). Additionally, the lock shaft 92 is inserted through a circular hole 148 formed in the cartridge lobe section 42 to cause the lock shaft 92 to project into the ramped track area 114 of the installed lock plate structure 82. The inserted lock shaft 92 is resiliently maintained in the track area 114 by then inserting the lock spring 96 into the opening 148 and then tightening the set screw 94 into the opening 148 to hold the lock spring 96 against the inserted lock shaft 92 (see FIG. 12).

As shown in FIGS. 12-14 and 16, with the assembled connector pin assembly 16 in its unlocked state (with the alignment marks 74,76 rotationally separated as shown in FIG. 6), the side wall 102 of the lock plate structure 82 is positioned against the side recess area abutment surface 64, with the lock plate structure side wall 100 spaced apart and facing the side recess area abutment surface 66, and the lock shaft 92 extending into the lock plate structure track portion 114*a* (see FIG. 8A) and opposing the track abutment 130.

Figure 9:
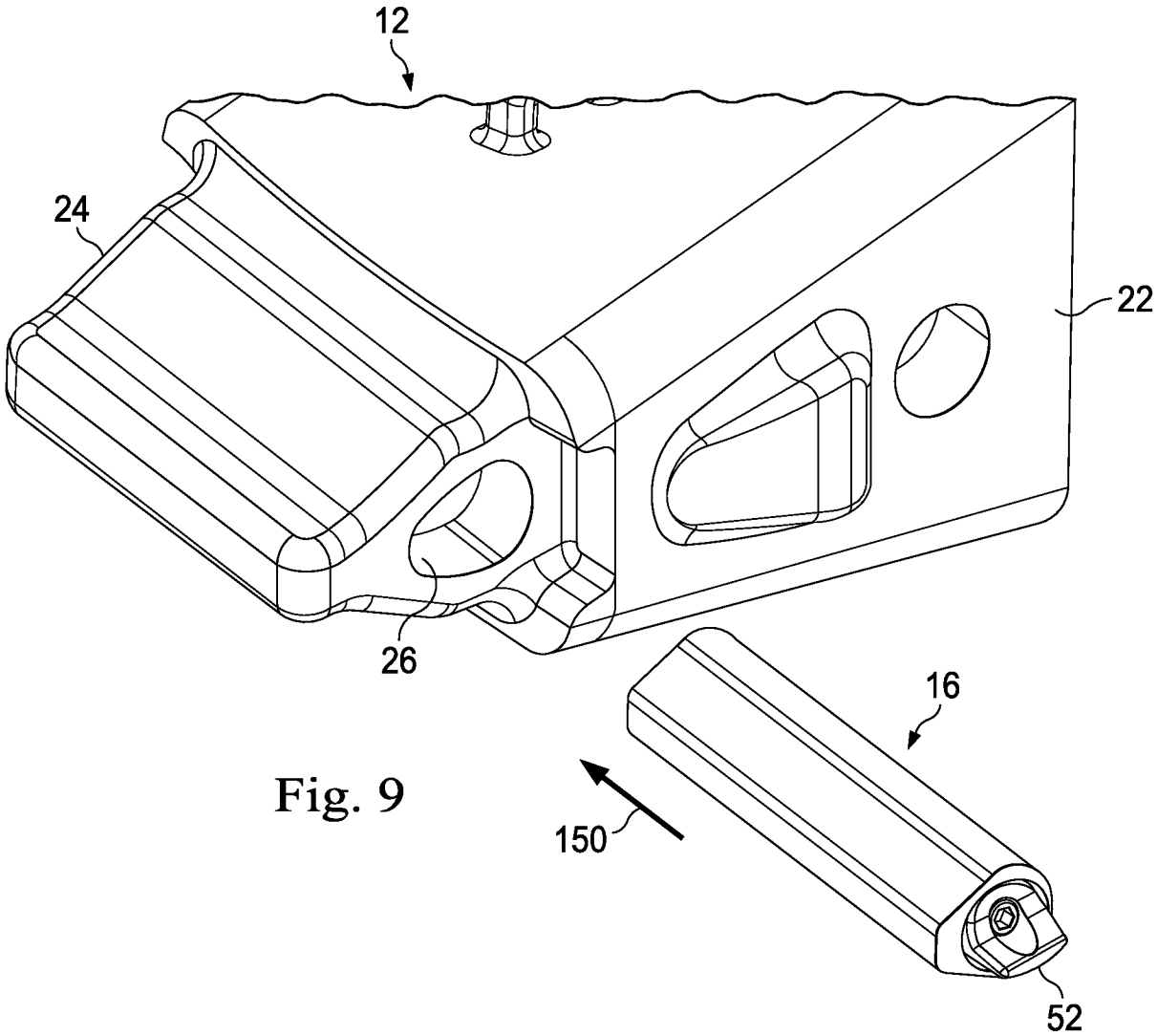
FIGS. 9-25 are perspective views of portions of representative ground engaging wear and support members, and the rotatable connector pin assembly, and illustrate the use of the rotatable connector pin assembly to releasably lock the wear and support members in an operative telescoped relationship.
Figure 10:
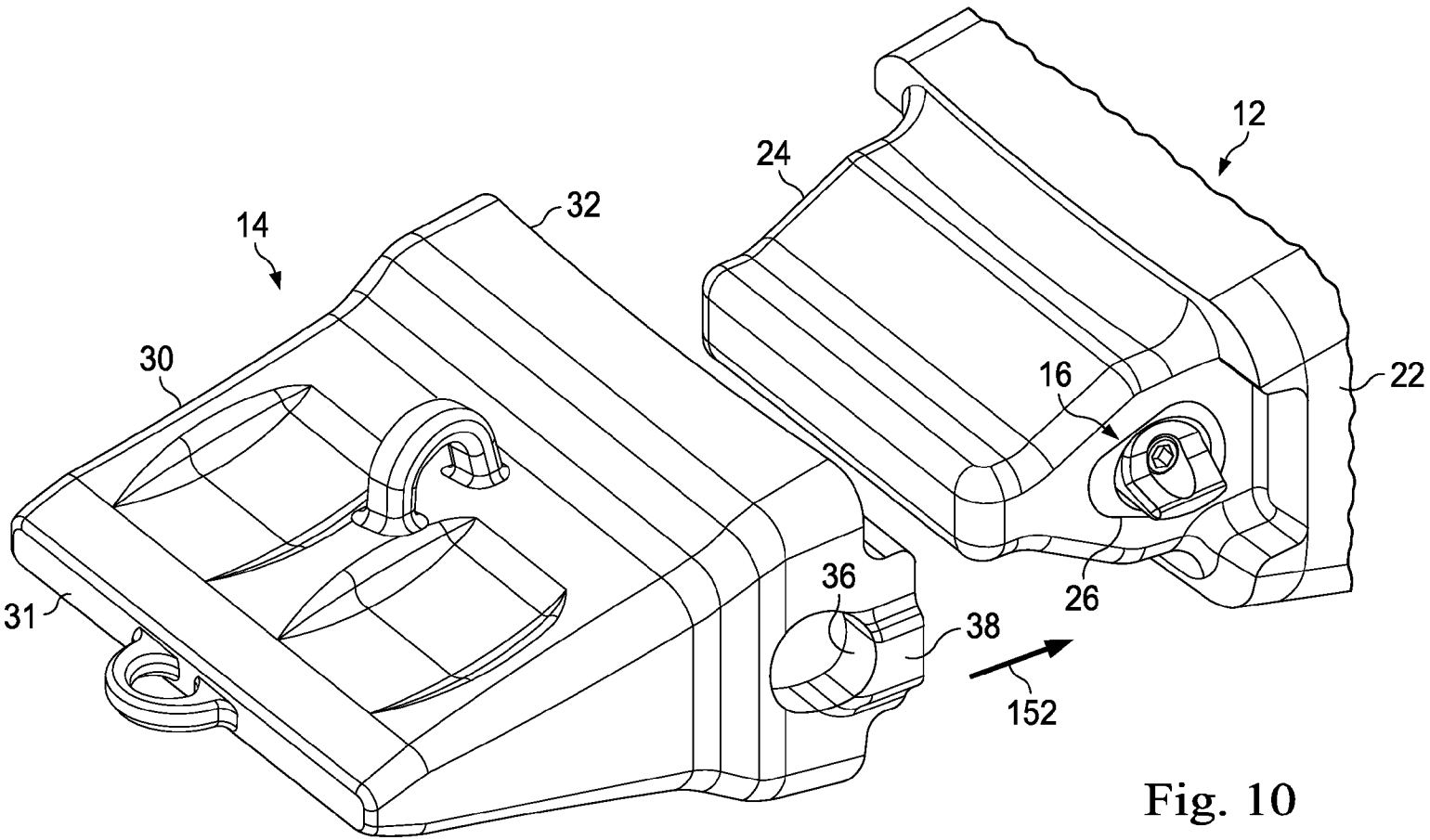
Figure 11:
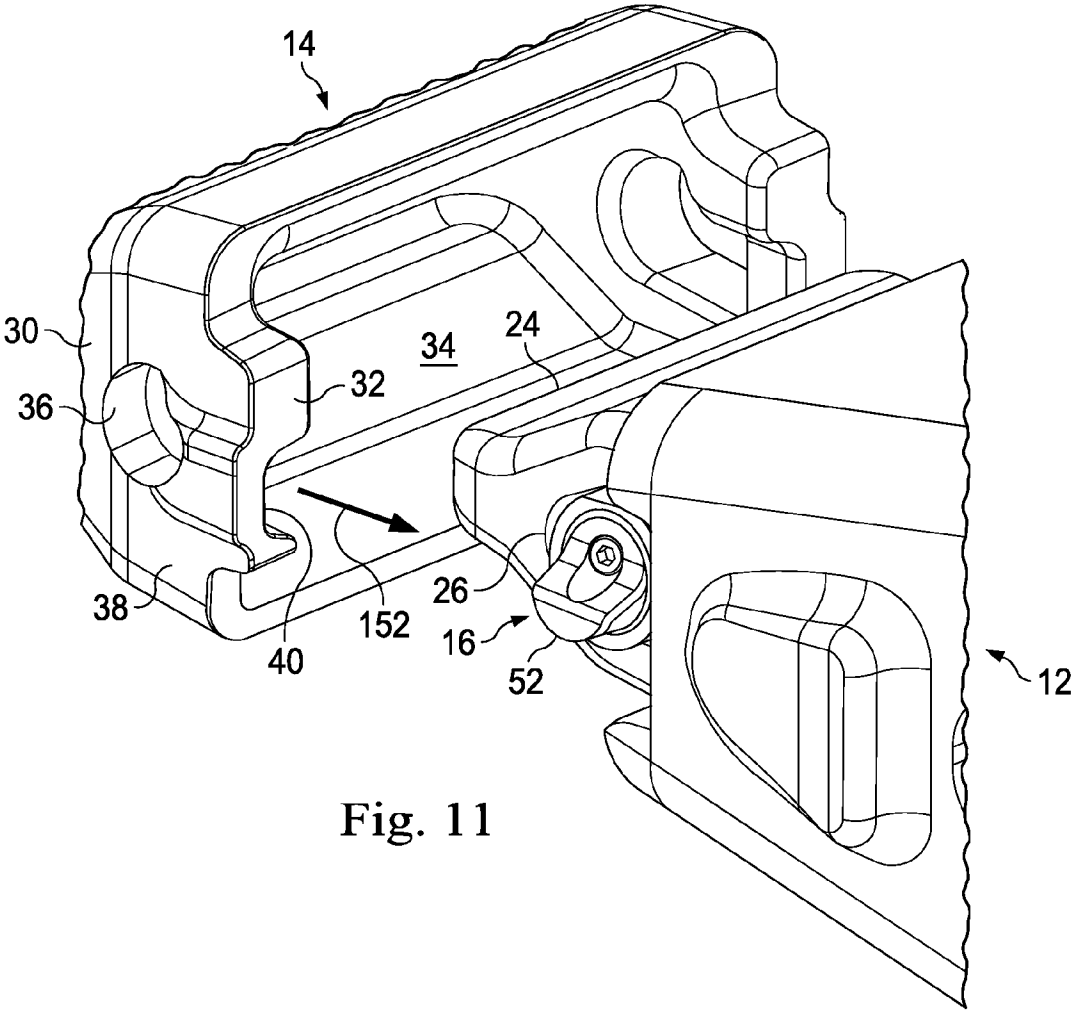
Figure 12:
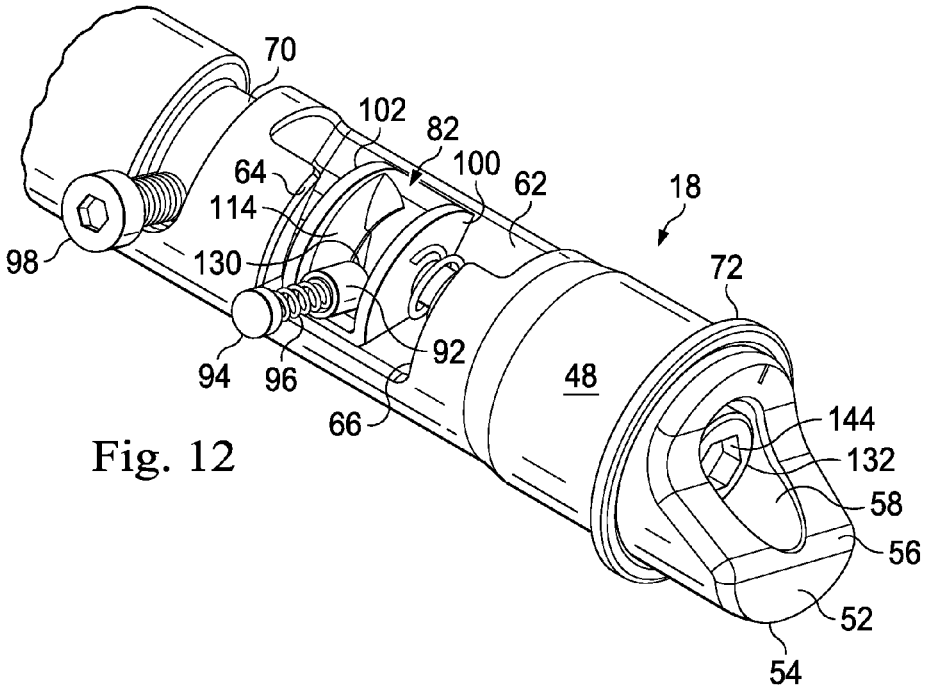
Figure 13:
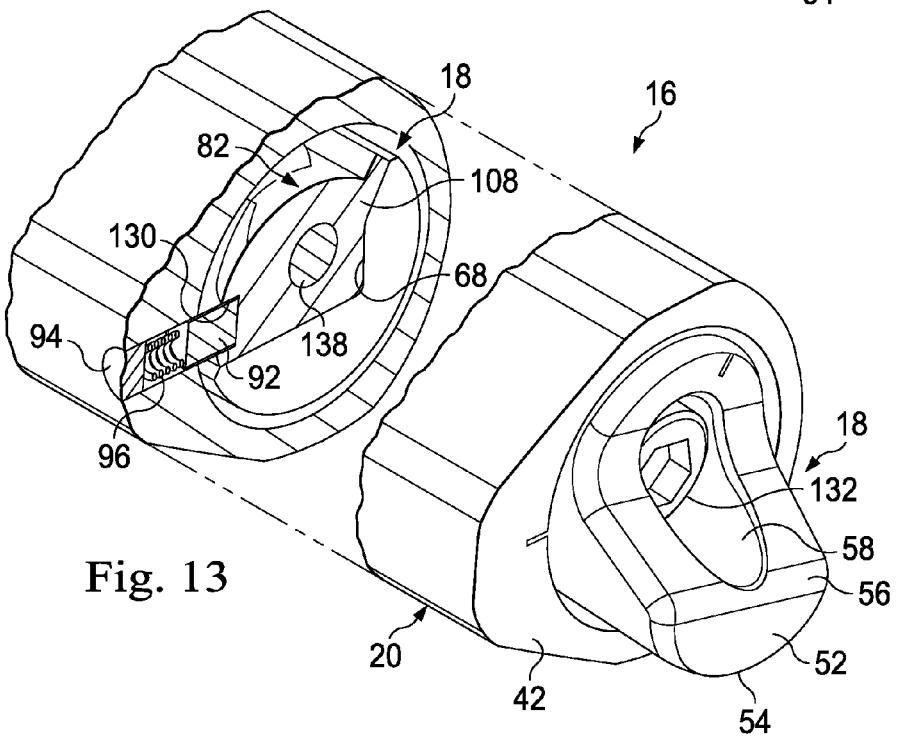

To operatively install the tooth point 14 on the adapter 12 (see FIGS. 9-11) the connector pin assembly 16 is first inserted into the adapter nose connector opening 26 as indicated by the arrow 150 in FIG. 9 so that the pin member end tabs 50,52 project outwardly from the opposite ends of the connector opening 26. Next, as indicated by the arrows 152 in FIGS. 10 and 11 and in a manner similar to that illustrated and described in the accompanying Exhibit A, the tooth point 14 is rearwardly telescoped onto the adapter nose 24 in a manner causing the connector pin tabs 50,52 to pass forwardly through the tooth point boss recesses 40 into the tooth point connector openings 36 as shown in FIGS. 10 and 11. Next, as subsequently described herein, the central bolt 84 is rotated to activate the specially designed locking system 80 which responsively functions to (1) rotate the connector pin assembly 16 to its locked orientation shown in FIG. 6A in which the markers 74,76 are aligned and the pin member end tabs 50,52 face rear surface portions 154 of the tooth point connector openings 36 (one of which being shown in FIG. 22) above the boss recesses 40 to thereby block forward removal of the tooth point 14 from the adapter nose 24, and (2) create a rigid abutment between the lock shaft 92 and the lock plate structure 82 that statically prevents rotation of the connector pin member 18 relative to the tubular cartridge 20.

Figure 7A:
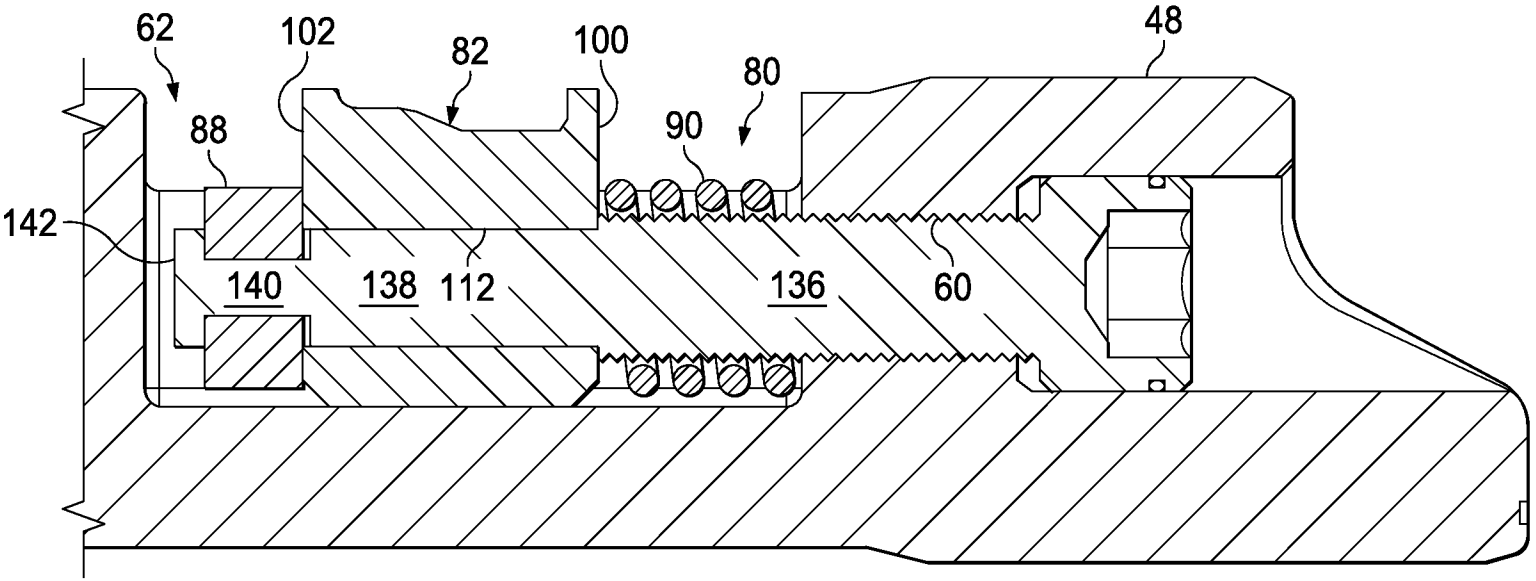
FIG. 7A is a simplified schematic assembled view of several locking parts of the rotatable connector pin assembly.
Figure 17:
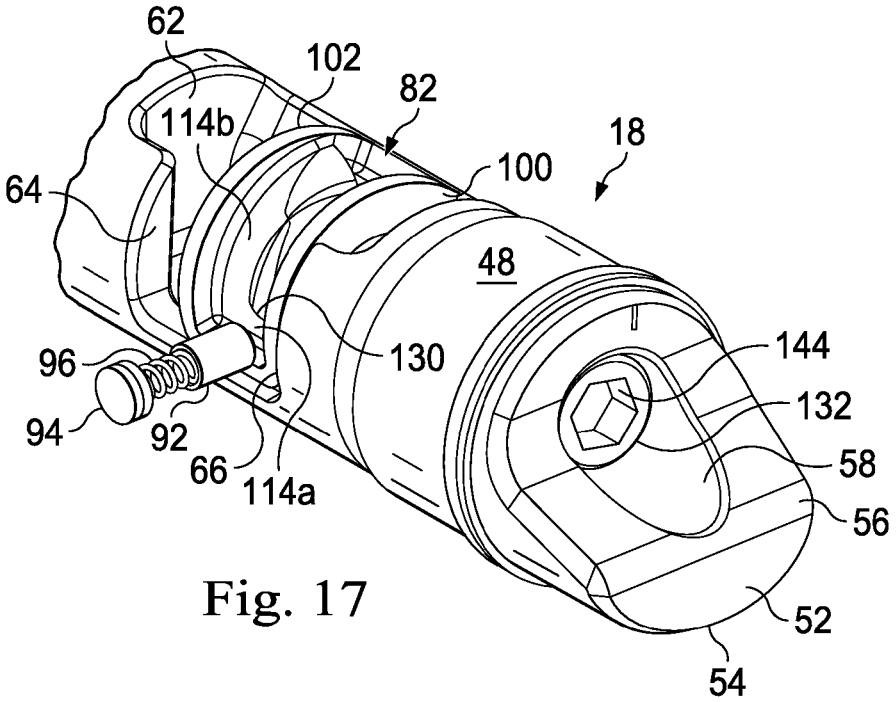
Figure 18:
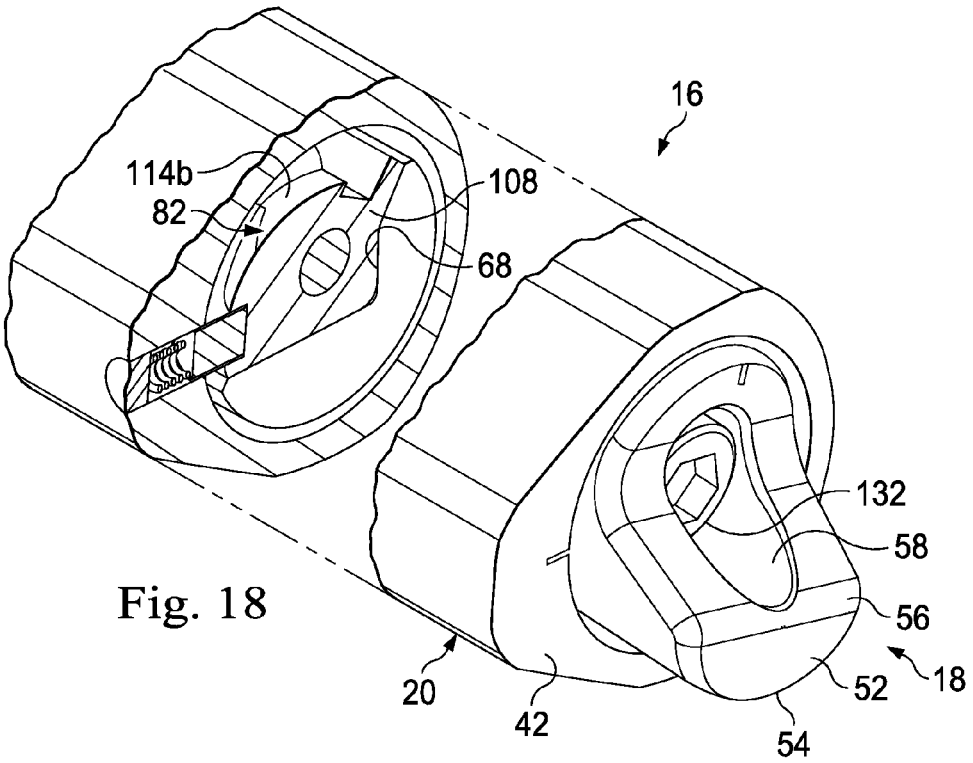
Figure 19:
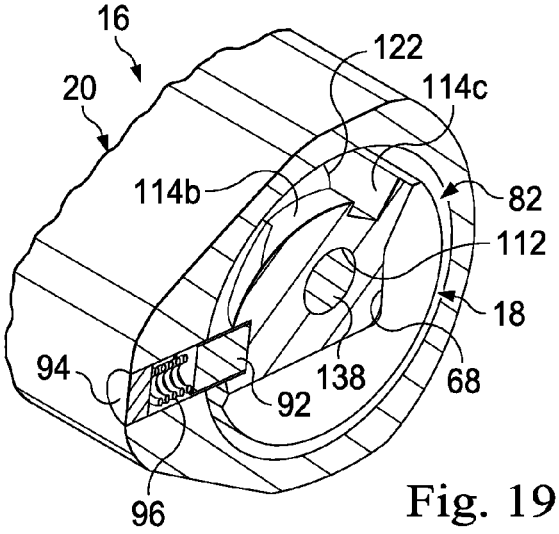
Figure 20:
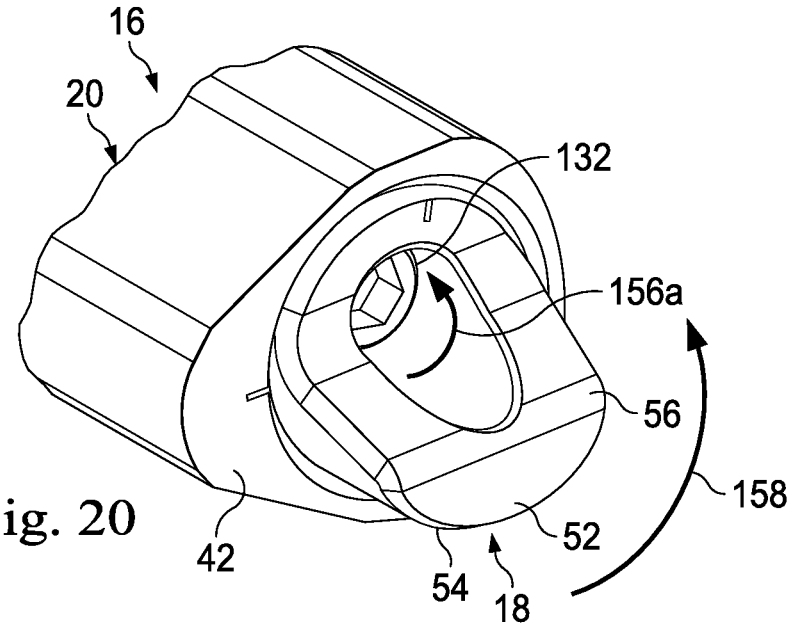
Figure 21:
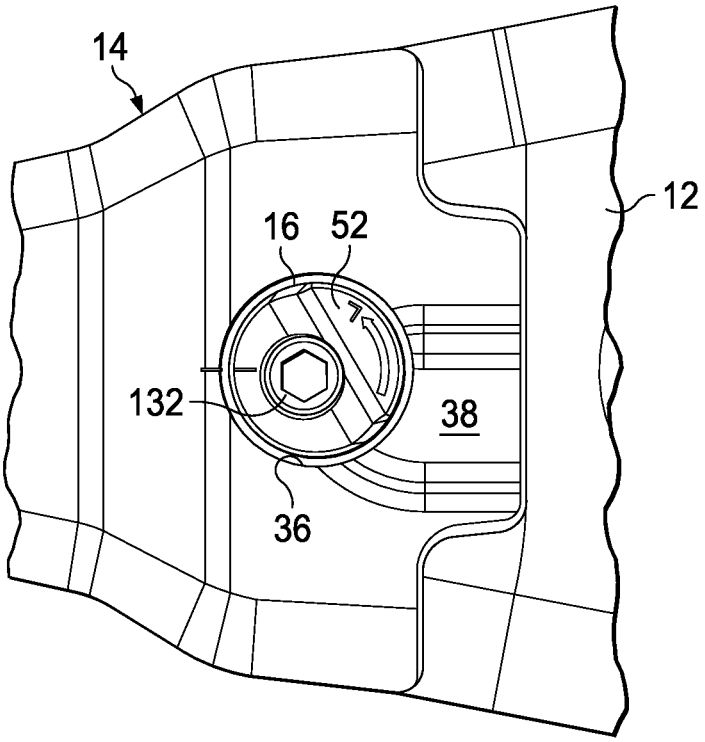
Figure 22:
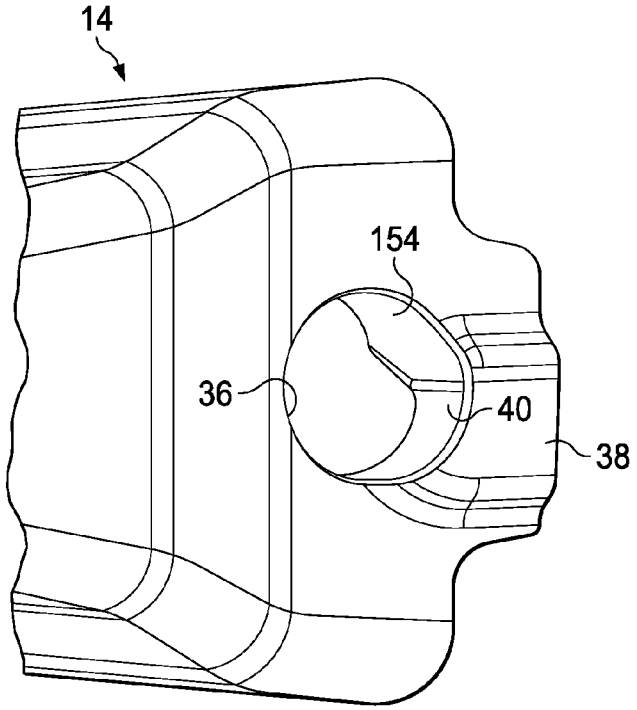

FIGS. 15-25, in a generally sequential manner, illustrate the operation of the specially designed locking system embodying principles of the present invention. With the connector pin assembly 16 in its unlocked orientation shown in FIGS. 15 and 16, the assembly 16 may be moved to its locked orientation by engaging and rotating the head portion 132 of the central bolt 84 in a counterclockwise direction relative to the tubular cartridge 20 as indicated by the arrows 156. Such counterclockwise rotation of the central bolt 84 rightwardly advances the bolt 84 to correspondingly translate the lock plate structure 82 rightwardly through the side recess area 62 of the connector pin member 18 (via the engagement of the lock plate structure 82 by the shaft collar 88 as shown in FIG. 7A) until the lock plate structure side wall 100 is brought into engagement with the pin member abutment surface 66 as shown in FIG. 17. This translation of the lock plate structure 82 relative to the connector pin member 18 and to the stationary lock shaft 92 causes the lock shaft 92 to leftwardly move through the track section 114*a*, and away from the track abutment 130, into alignment with the entrance to the track section 114*b* as depicted in FIGS. 17-19.

At this point, the lock shaft 92 is free to travel circumferentially through the lock plate track section 114*b*. Due to the frictional engagement between the split shaft collar 88 and the lock plate structure 82 (see FIG. 7A) caused by the compression of the central spring 90, further counterclockwise rotation of the central bolt head 132 relative to the connector pin member 18, as indicated by the arrow 156*a* in FIG. 20, rotates both the connector pin 18 and the lock plate structure 82 in a counterclockwise direction relative to the tubular cartridge 20, as indicated by the arrow 158 in FIG. 20, to thereby cause the lock shaft 92 to travel through the track section 114*b* (see FIG. 8A), upwardly over its associated exit end ramp 120 (which compresses the lock spring 96) and then snap downwardly into the track section 114*c* in a facing relationship with the ramp abutment surface 122. This places the connector pin assembly 16 in its locked orientation as shown in FIGS. 21 and 23-25. In such locked orientation of the connector pin assembly 16, the rotated connector pin end tabs 50,52 are rotated out of alignment with the tooth point boss slots 40 (see FIG. 11) and face the surface areas 154 of the tooth point connector openings 36 to thereby block forward removal of the tooth point 14 from the adapter nose 24.

Figure 23:
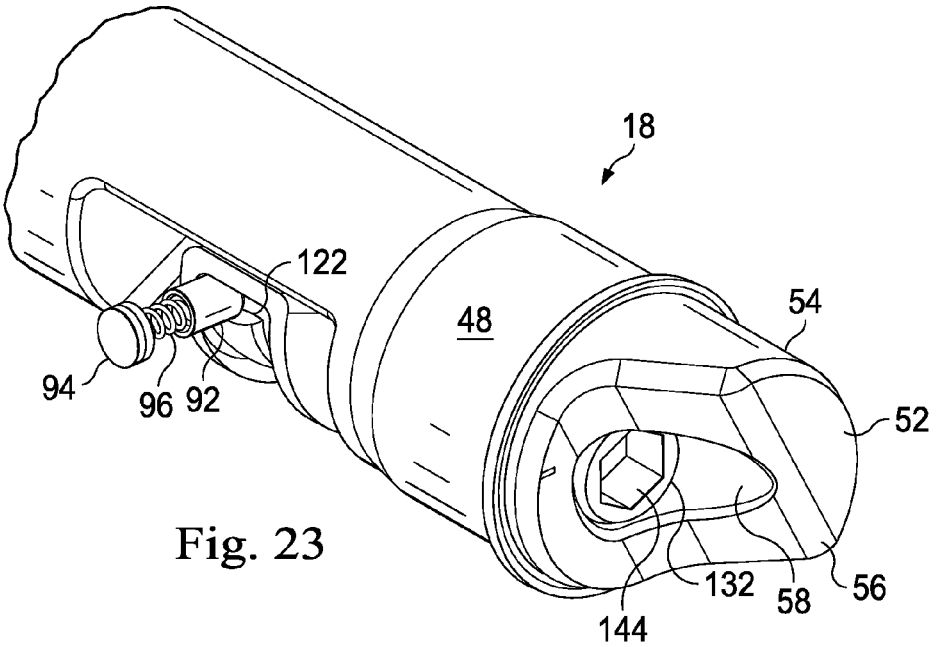
Figure 24:
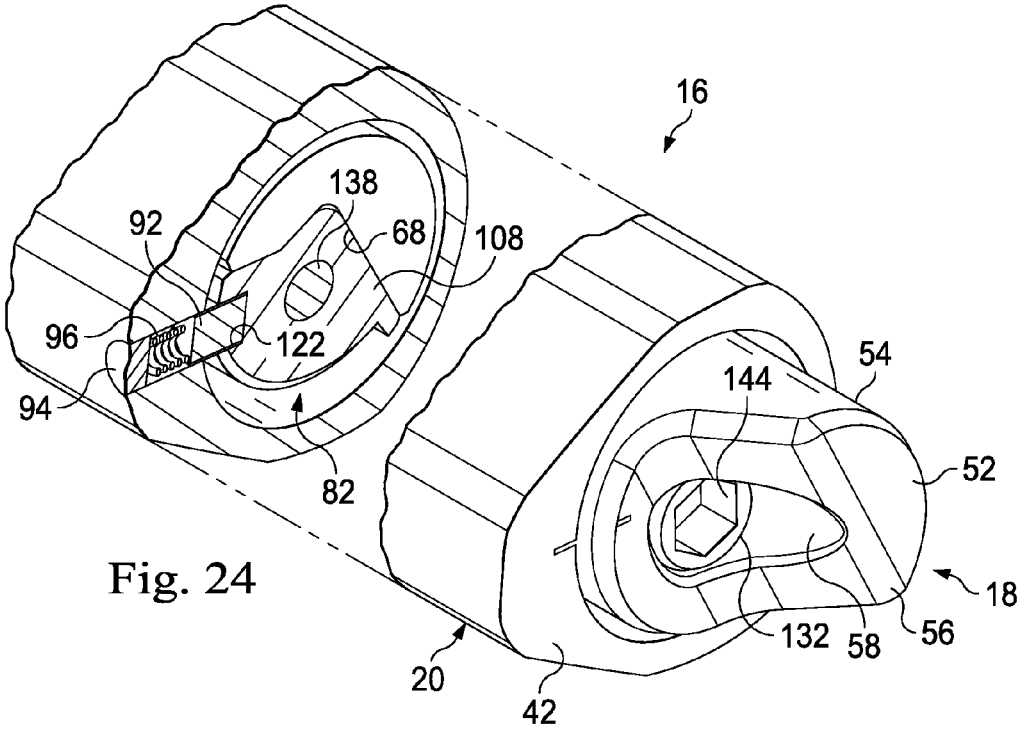
Figure 25:
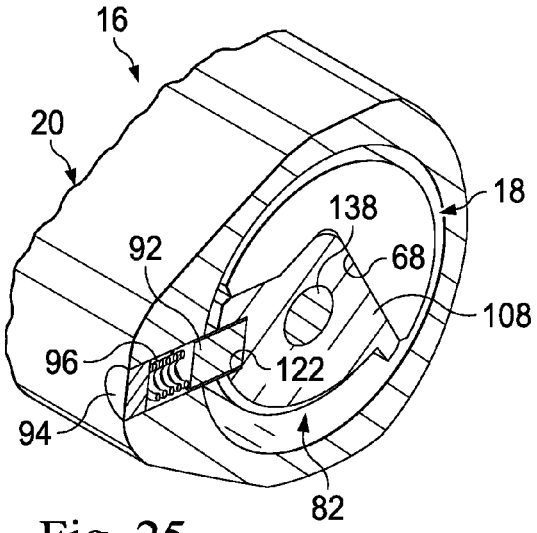

As can be seen in FIGS. 23-25, with the connector pin assembly 16 in its locked orientation, the connector pin 16 and the tubular cartridge 20 are statically locked together, via the rigid abutment between the lock shaft 92 and the lock plate structure 82, in a manner such that operational forces imposed on the installed connector pin structure 16 cannot undesirably shift it to its unlocked orientation.

Figure 26:
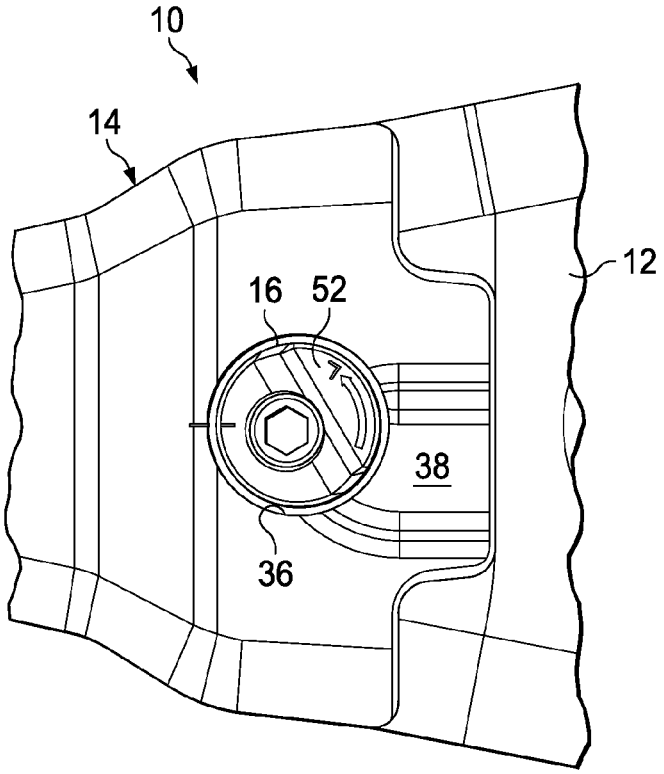
FIGS. 26-32 are perspective views of portions of the ground engaging wear and support members, and the rotatable connector assembly, and illustrate the unlocking of the rotatable connector pin assembly to permit the removal of the wear member from the support member onto which it is telescoped.
Figure 27:
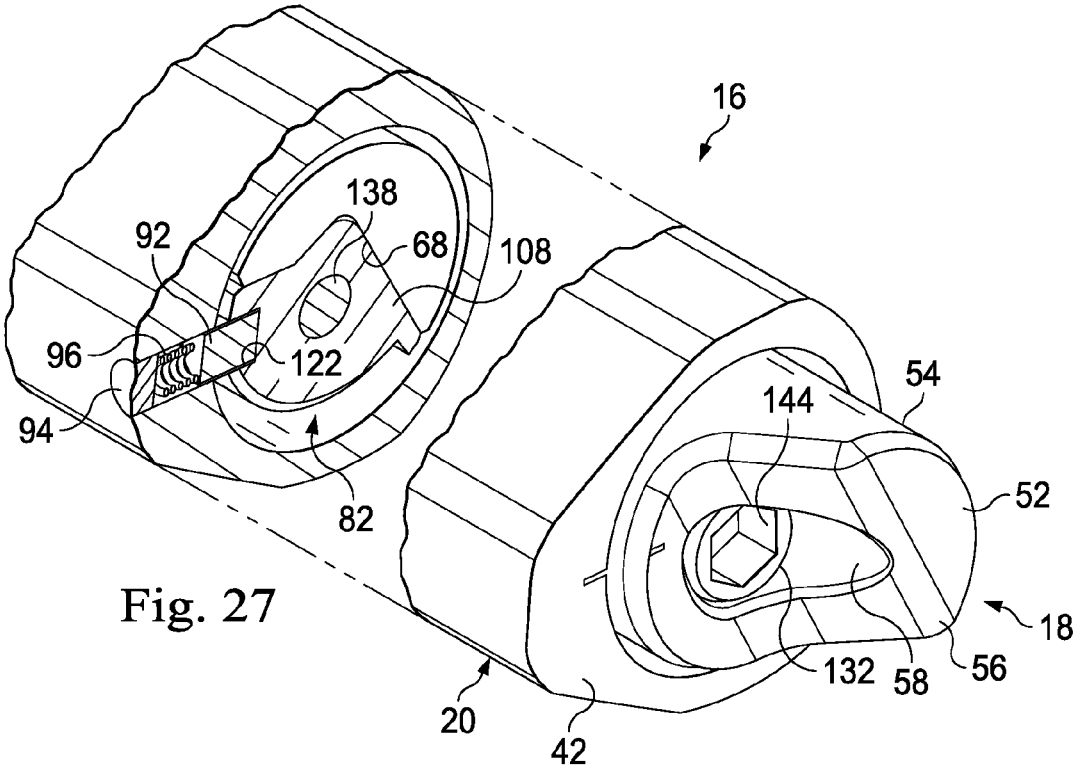
Figure 28:
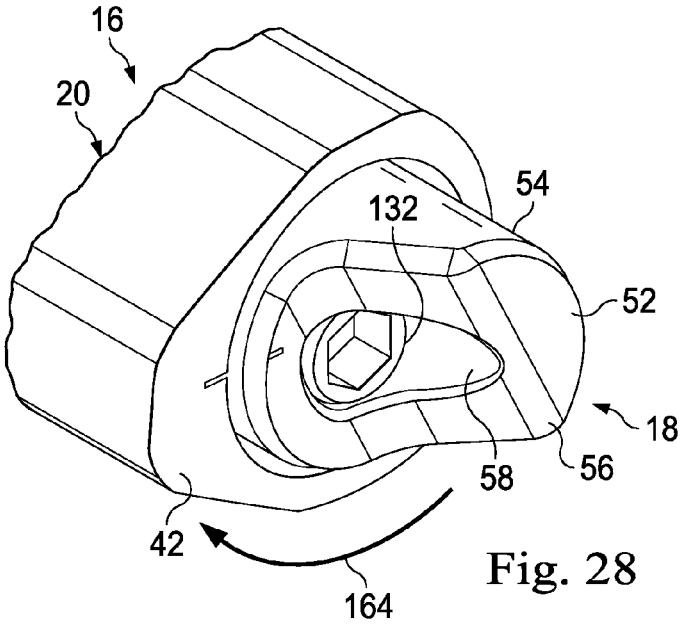

FIGS. 26-32, in a generally sequential manner, illustrate the procedure for reorienting the connector pin assembly 16 from its locked position to its unlocked position to permit forward removal of the tooth point 14 from the adapter nose 24. FIGS. 26 and 27 illustrate the connector pin assembly 16 in its previously described locked orientation. To initiate the re-orientation procedure, the central bolt head 132 (FIG. 28) is rotated in a clockwise direction relative to the connector pin 18, as indicated by the arrow 164, to leftwardly translate the lock plate structure 82, using the axial force of the central bolt face 163 (see FIG. 7) against the lock plate side wall 100 and the compressed central spring 90, until the lock plate structure side wall 102 engages the pin member abutment surface 64 (see FIG. 7) at which point the lock shaft 92 has traversed the lock plate track section 114*c* (see FIG. 8A) and is aligned with the entrance to the track section 114*d* (see FIG. 29).

Figure 29:
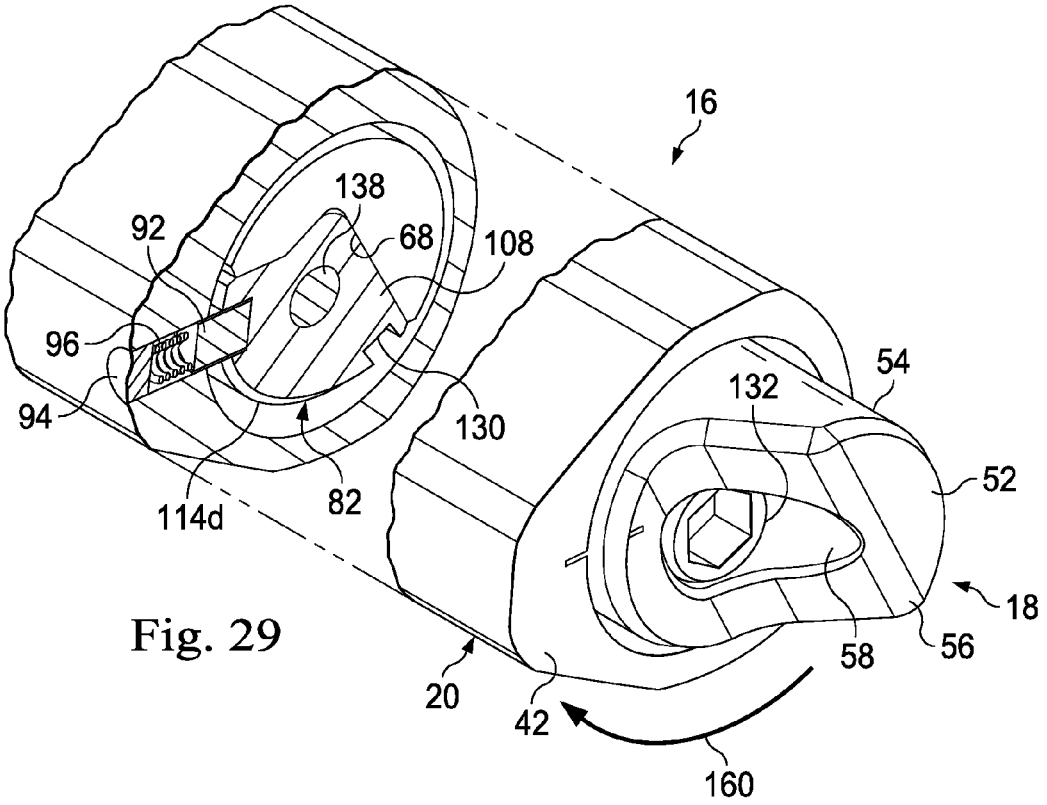
Figure 30:
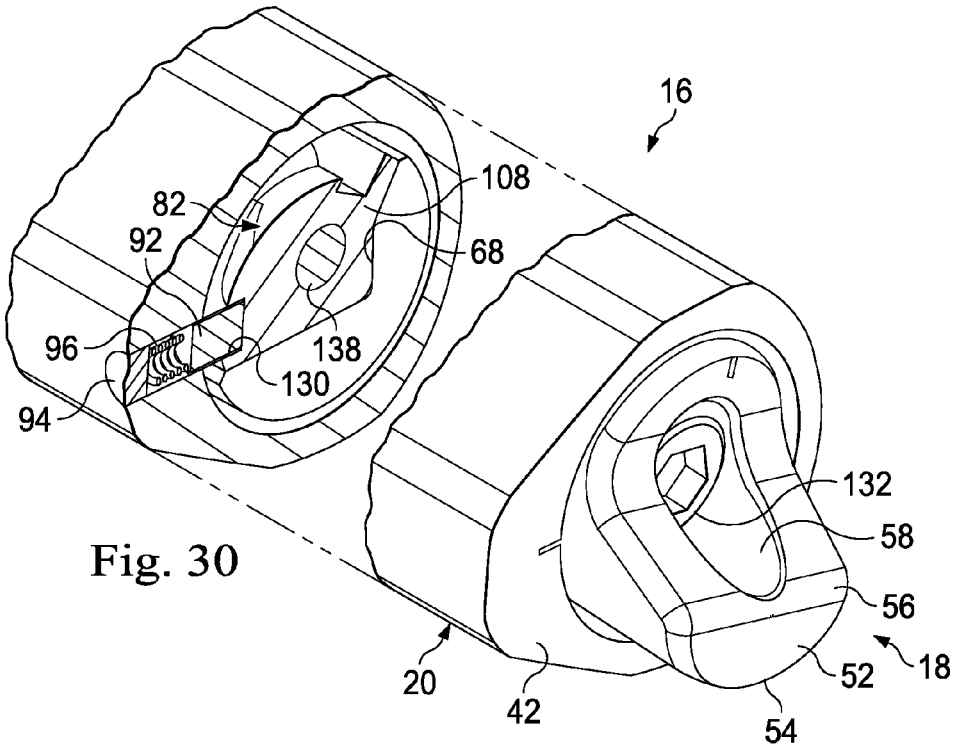
Figure 31:
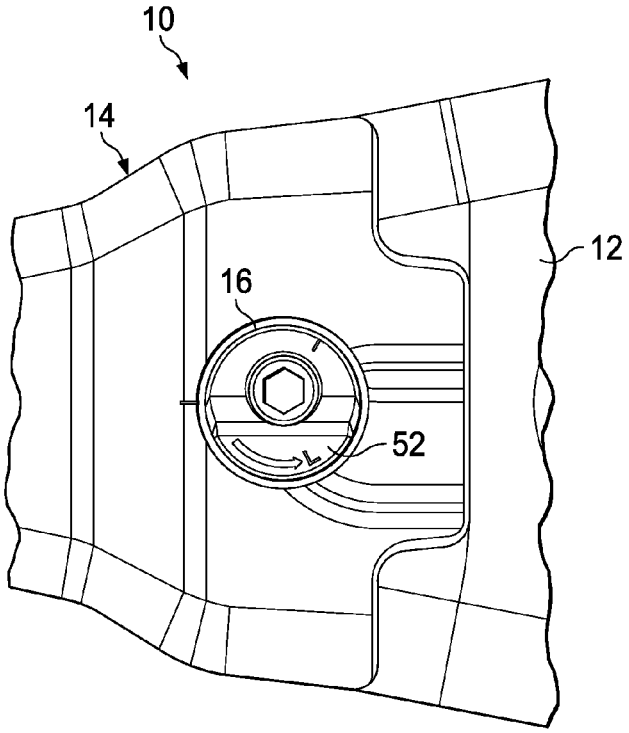
Figure 32:
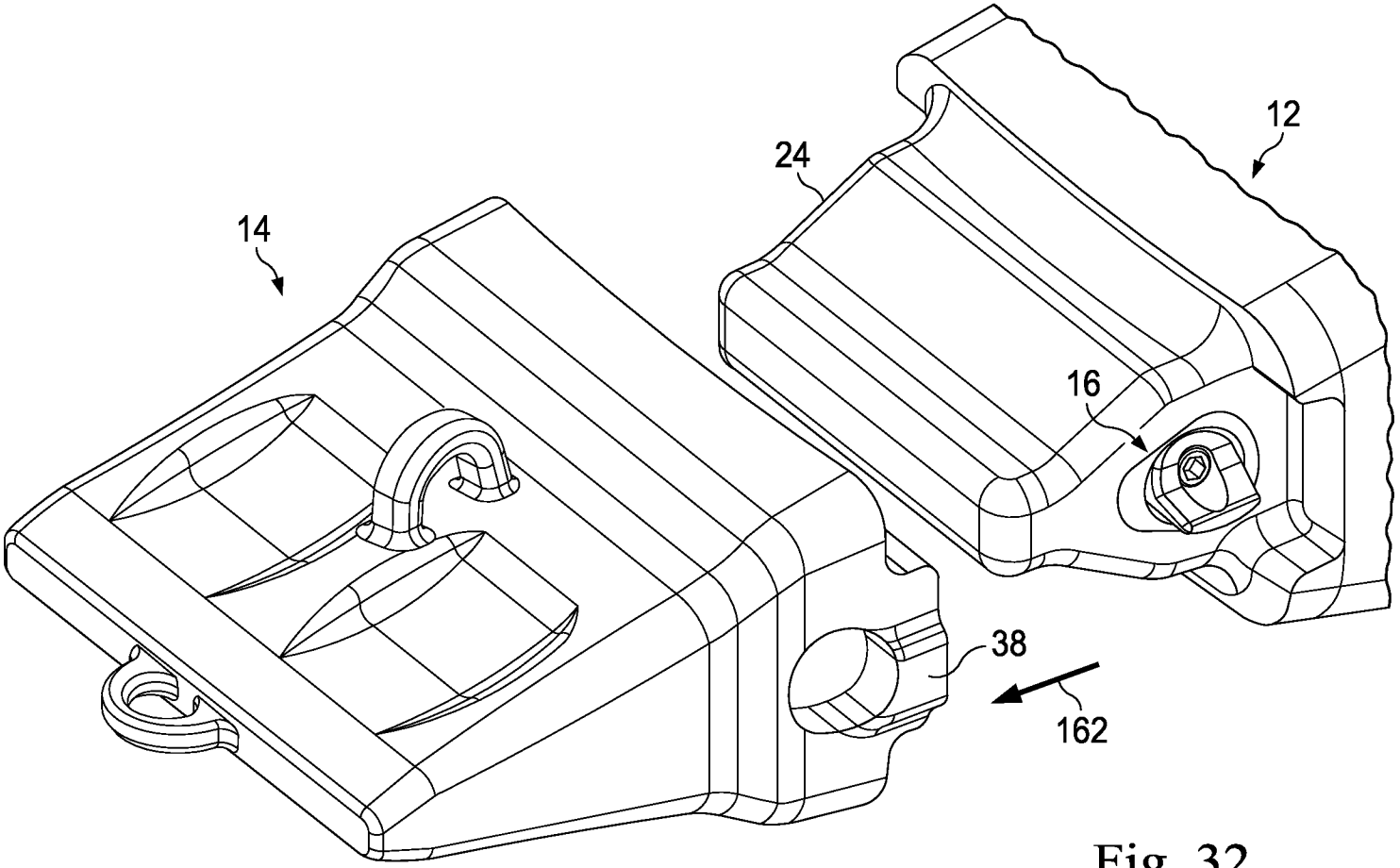

Next, the bolt head 132 is rotated further in a clockwise direction to cause clockwise rotation of the connector pin member 16 relative to the tubular cartridge 20 as indicated by the arrow 160 in FIG. 29, thereby causing the lock shaft 92 to traverse the track section 114*d* (see FIG. 8A), travel upwardly over its associated ramp portion 128, and then snap inwardly into the track section 114*a* in a facing relationship with the ramp abutment 130 as shown in FIG. 30 to return the rotatable connector pin assembly 16 to its previous unlocked orientation. In such orientation, the connector pin member 18 is statically locked therein by the rigid abutment between the lock shaft 92 and the lock plate structure 82. With the connector pin assembly 16 returned to its unlocked position as shown in FIG. 31, the tooth point 14 may be forwardly removed from the adapter nose 24 as indicated by the arrow 162 in FIG. 32.

Figure 33:
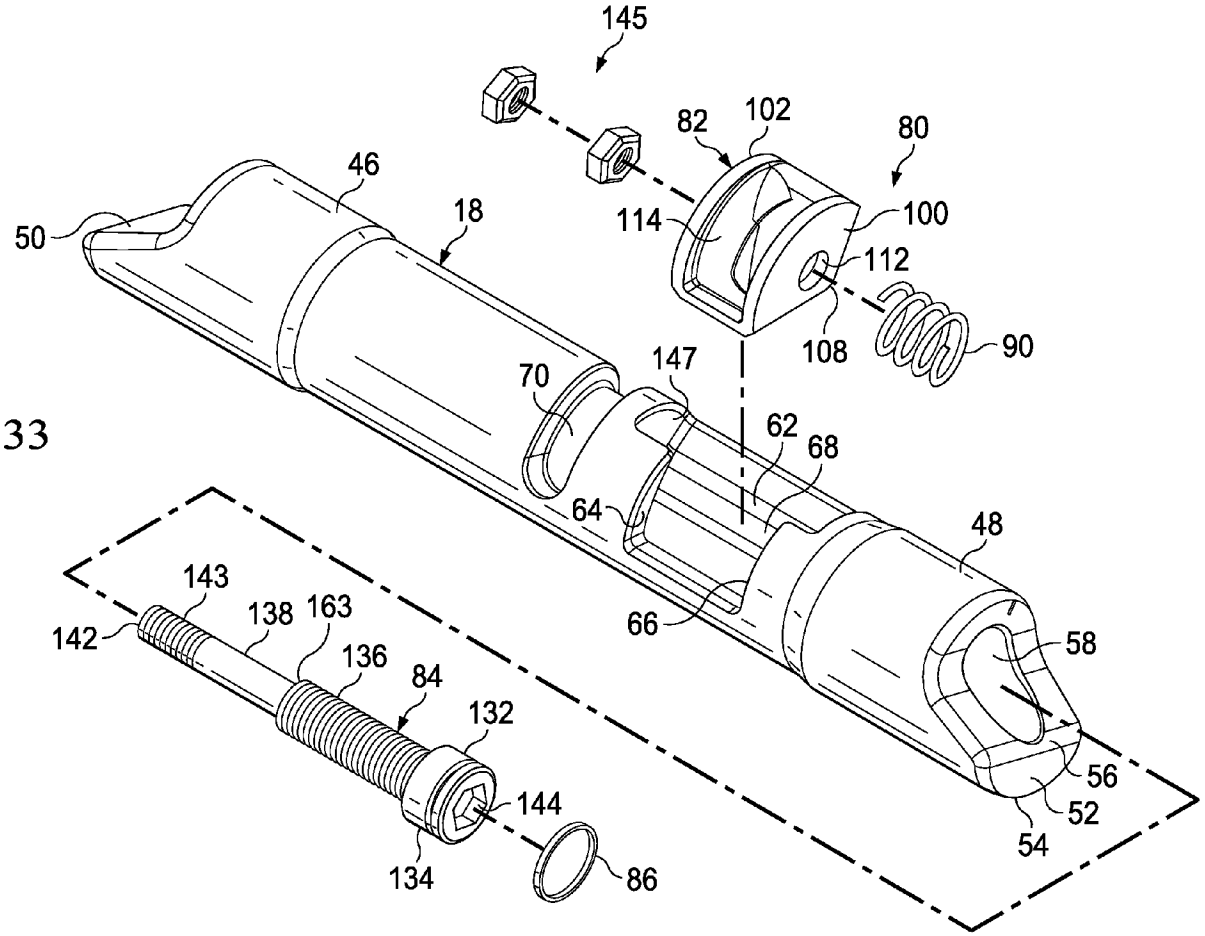
FIG. 33 is an enlarged scale exploded perspective view of a portion of the rotatable connector pin assembly according to an exemplary embodiment consistent with the principles herein.
Figure 33A:
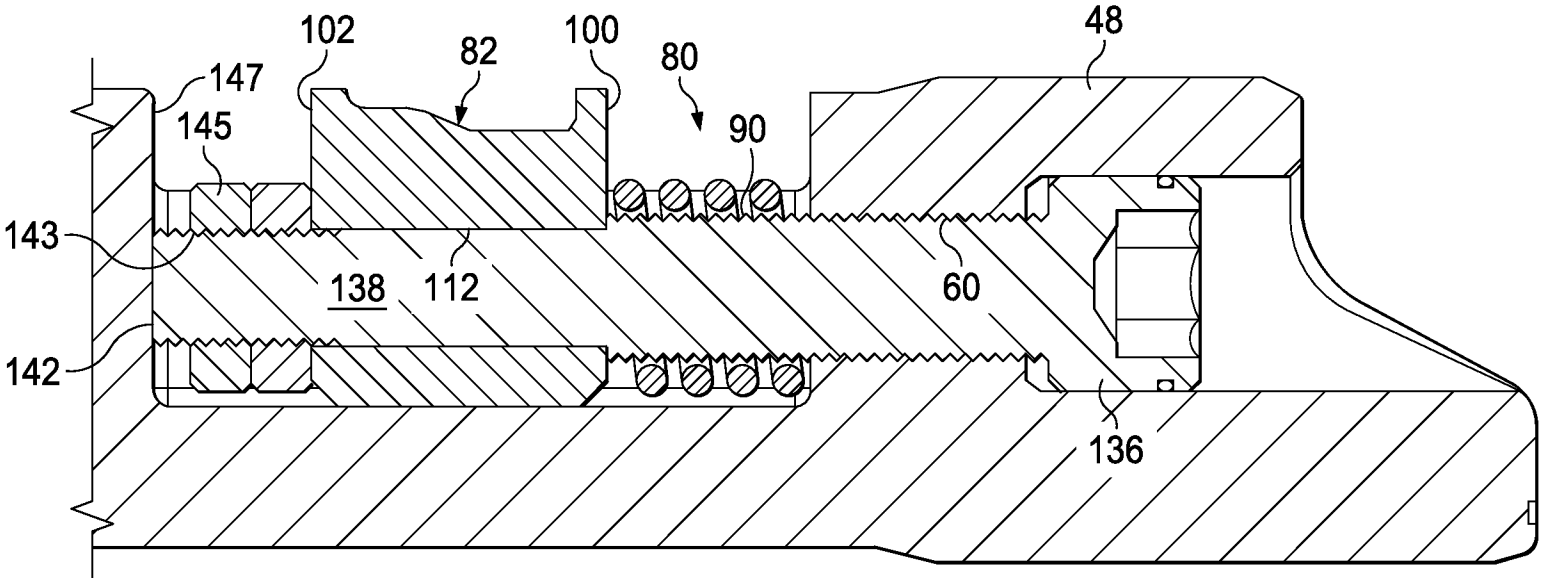
FIG. 33A is a simplified schematic assembled view of several locking parts of the rotatable connector pin assembly according to an exemplary embodiment consistent with the principles herein.

FIGS. 33 and 33A illustrate an embodiment of the pin member 18 in which a set of two nuts 145 are used in place of the shaft collar 88. According to the present example, the distal end of the drive bolt 84 includes a threaded portion 143 that is configured to engage with the set of nuts 145. The threaded portion 143 is in place of the non-threaded portion 140 that is used in accordance with the shaft collar embodiment described above. In this example, an abutment surface 147 acts as a stopping mechanism against the bolt end portion 142 of the drive bolt 84 at which point the lock shaft 92 has traversed the lock plate track section 114*c*. Thus, in this case, the lock plate structure sidewall 102 of the lock plate 82 does not necessarily contact abutment surface 64.

In summary, the incorporation of the previously described static locking system 80 in the overall rotatable connector pin assembly 16 provides the assembly 16 with substantially improved pin/cartridge rotational orientation locking capability compared to that of the rotatable connector pin assembly shown in FIGS. 1-7 of U.S. Pat. No. 6,976,325 without substantially altering the overall connector pin assembly external configuration or the manner in which its pin member end portions are used to block the removal of a wear member from a support member onto which the wear member is telescoped.

The foregoing detailed description is to be clearly understood as being given by way of illustration and example only, the spirit and scope of the present invention being limited solely by the appended claims.

What is claimed is:

1. For use in removably retaining a ground-engaging wear member on an associated support structure having a connector opening therein, a rotatable connector pin assembly comprising:

a tubular hollow body longitudinally extending along an axis and being nonrotatably receivable in the connector opening:

a connector pin member having a cylindrical body portion coaxially received in tubular hollow body and having an outer end portion projecting outwardly beyond an outer end of said tubular hollow body, said connector pin member being rotatable relative to said tubular hollow body between first and second rotational orientations relative to said tubular hollow body; and static locking apparatus operative to selectively and releasably prevent rotation of said connector pin member relative to said tubular hollow body, away from either of said first and second rotational orientations toward the other of said first and second rotational orientations, caused by ground engagement force exerted on said connector pin member, said static locking apparatus comprising:

a drive member extending into said connector pin member and being threadingly movable longitudinally inwardly and outwardly through said connector pin member, and first and second blocking structures respectively associated with said connector pin member and said tubular hollow body and being cooperatively engageable in response to rotation of said drive member to selectively and rigidly block rotation of said connector pin member relative to said hollow body;

wherein:

said connector pin member has a side recess therein;

said first blocking structure is received in said side recess and coupled to a longitudinal portion of said drive member for longitudinal movement therewith through said side recess when said drive member is threadingly moved through said connector member, said first blocking member having a track formed therein and having circumferentially oppositely facing, axially spaced apart first and second abutment surfaces; and said second blocking structure extends into said track from said tubular hollow body and is respectively and blockingly engageable by said first and second abutment surfaces when said connector pin is in said first and second rotational orientations thereof.

2. The rotatable connector pin assembly of claim 1 wherein:

said first and second rotational orientations of said connector pin member are approximately 120 degrees apart from one another.

3. The rotatable connector pin assembly of claim 1 wherein:

said outer end portion of said connector pin member is laterally reduced relative to said cylindrical body portion of said connector pin member.

4. The rotatable connector pin assembly of claim 1 wherein:

said drive member is an elongated drive bolt longitudinally extending coaxially through and threadingly engaged with said connector pin member.

5. The rotatable connector pin assembly of claim 4 wherein:

said outer end portion of said connector pin member has a side recess therein, and said drive bolt has a drivable head portion axially movable through said side recess.

6. The rotatable connector pin assembly of claim 1 further comprising:

a spring structure carried by said drive member and interposed between said first blocking structure and a facing surface of said connector pin member, said spring structure biasing said first blocking member axially away from said facing surface of said connector pin member.

7. The rotatable connector pin assembly of claim 1 wherein:

said first blocking member is nonrotatable relative to said connector pin member, said track has first and second ramped portions respectively disposed at said first and second abutment surfaces, and said second blocking structure is a spring-loaded detent member operative to be compressed by said first and second ramped portions and then sequentially expand in to facing orientations with said first and second abutment surfaces in response to rotation in opposite directions of said connector pin member relative to said tubular hollow body.

8. The rotatable connector pin assembly of claim 1 further comprising:

third and fourth blocking structures respectively associated with said tubular hollow body and said connector pin member and being cooperatively engageable to prevent appreciable relative axial movement between said tubular hollow body and said connector pin member, but permit rotation of said connector pin member between said first and second rotational orientations thereof relative to said tubular hollow body.

9. The rotatable connector pin assembly of claim 8 wherein:

said third blocking structure is a bolt member extending radially inwardly from said tubular hollow body, and said fourth blocking structure is a circumferentially extending groove formed in said connector pin member and slidably receiving said bolt member.

10. Connector pin apparatus for use in removably retaining a ground-engaging wear member on an associated support structure, said connector pin apparatus comprising:

a connector pin member having an interior space disposed longitudinally inwardly of an outer end portion thereof and a side opening extending outwardly through a side surface portion of said connector pin member;

a drive member threaded into said outer end portion of said connector pin member and having an inner end portion longitudinally extending into said interior space for movement in opposite longitudinal directions therethrough in response to rotation of said drive member relative to said connector pin member; and a lock structure nonrotatably received in said interior space for longitudinal translation therein and having a side surface recess facing radially outwardly relative to said connector pin member, said side surface recess being generally aligned with said side opening of said interior space and having therein a ramped detent track, said lock structure being secured to said inner end portion of said drive member for longitudinal movement therewith through said connector pin member interior space in response to rotation of said drive member relative to said connector pin member.

11. The connector pin apparatus of claim 10 wherein:

said connector pin member has laterally narrowed opposite end portions.

12. The connector pin apparatus of claim 10 wherein:

said outer end portion of said connector pin member has a side recess therein, and said drive member is an elongated drive bolt having a head portion received in said side recess of said outer end portion of said connector pin member for axial movement therethrough.

13. The connector pin apparatus of claim 10 further comprising:

a spring structure carried by said drive member and interposed between said lock structure and a facing surface of said connector pin member, said spring structure biasing said lock structure axially away from said facing surface of said connector pin member.

14. The connector pin apparatus of claim 10 wherein:

said ramped detent track has first and second axially spaced apart ramp portions on which circumferentially oppositely facing first and second abutment surfaces are respectively formed.

15. The connector pin apparatus of claim 10 wherein:

said connector pin has a circumferentially extending external side surface groove formed thereon.

16. Ground engaging apparatus comprising:

a support member having a connector opening extending therethrough;

a wear member telescoped onto the support member and having spaced apart connector openings aligned with the connector opening of said support member; and a connector pin assembly extending through the connector openings of said support member and said wear member and releasably retaining said wear member on said support member, said connector pin assembly including:

a tubular hollow body longitudinally extending along an axis and being nonrotatably receivable in the connector opening:

a connector pin member having a cylindrical body portion coaxially received in tubular hollow body and having an outer end portion projecting outwardly beyond an outer end of said tubular hollow body, said connector pin member being rotatable relative to said tubular hollow body between first and second rotational orientations relative to said tubular hollow body; and static locking apparatus operative to selectively and releasably prevent rotation of said connector pin member relative to said tubular hollow body, away from either of said first and second rotational orientations toward the other of said first and second rotational orientations, caused by ground engagement force exerted on said connector pin member, said static locking apparatus including:

a drive member extending into said connector pin member and being threadingly movable longitudinally inwardly and outwardly through said connector pin member, and first and second blocking structures respectively associated with said connector pin member and said tubular hollow body and being cooperatively engageable in response to rotation of said drive member to selectively and rigidly block rotation of said connector pin member relative to said hollow body;

third and fourth blocking structures respectively associated with said tubular hollow body and said connector pin member and being cooperatively engageable to prevent appreciable relative axial movement between said tubular hollow body and said connector pin member, but permit rotation of said connector pin member between said first and second rotational orientations thereof relative to said tubular hollow body, wherein:

said third blocking structure is a bolt member extending radially inwardly from said tubular hollow body; and said fourth blocking structure is a circumferentially extending groove formed in said connector pin member and slidably receiving said bolt member.

17. The ground engaging apparatus of claim 16 wherein:

said first and second rotational orientations of said connector pin member are approximately 120 degrees apart from one another.

18. The ground engaging apparatus of claim 16 wherein:

said outer end portion of said connector pin member is laterally reduced relative to said cylindrical body portion of said connector pin member.

19. The ground engaging apparatus of claim 16 wherein:

said drive member is an elongated drive bolt longitudinally extending coaxially through and threadingly engaged with said connector pin member.

20. The ground engaging apparatus of claim 19 wherein:

said outer end portion of said connector pin member has a side recess therein, and said drive bolt has a drivable head portion axially movable through said side recess.

21. The ground engaging apparatus of claim 16 wherein:

said connector pin member has a side recess therein, said first blocking structure is received in said side recess and coupled to a longitudinal portion of said drive member for longitudinal movement therewith through said side recess when said drive member is threadingly moved through said connector member, said first blocking member having a track formed therein and having circumferentially oppositely facing, axially spaced apart first and second abutment surfaces, and said second blocking structure extends into said track from said tubular hollow body and is respectively and blockingly engageable by said first and second abutment surfaces when said connector pin is in said first and second rotational orientations thereof.

22. The ground engaging apparatus of claim 21 further comprising:

a spring structure carried by said drive member and interposed between said first blocking structure and a facing surface of said connector pin member, said spring structure biasing said first blocking member axially away from said facing surface of said connector pin member.

23. The ground engaging apparatus of claim 21 wherein:

said first blocking member is nonrotatable relative to said connector pin member, said track has first and second ramped portions respectively disposed at said first and second abutment surfaces, and said second blocking structure is a spring-loaded detent member operative to be compressed by said first and second ramped portions and then sequentially expand in to facing orientations with said first and second abutment surfaces in response to rotation in opposite directions of said connector pin member relative to said tubular hollow body.

24. A rotatable connector pin assembly arranged to removably retain a ground-engaging wear member on an associated support structure having a connector opening therein, the connector pin assembly comprising:

a tubular hollow body longitudinally extending along an axis and being nonrotatably receivable in the connector opening:

a connector pin member having a cylindrical body portion coaxially received in tubular hollow body and having an outer end portion projecting outwardly beyond an outer end of said tubular hollow body, said connector pin member being rotatable relative to said tubular hollow body between first and second rotational orientations relative to said tubular hollow body; and a locking apparatus operative to selectively and releasably prevent rotation of said connector pin member relative to said tubular hollow body, away from either of said first and second rotational orientations toward the other of said first and second rotational orientations, caused by ground engagement force exerted on said connector pin member, said locking apparatus comprising:

a drive member extending into said connector pin member and being rotatably displaceable to move the drive member between a first position that cooperatively rotatably locks the connector pin member relative to the tubular hollow body and a second position that cooperatively allows the connector pin member to rotate relative to the tubular hollow body;

a laterally extending lock shaft cooperatively engageable with both said connector pin member and said tubular hollow body in response to rotation of said drive member to selectively and rigidly block rotation of said connector pin member relative to said hollow body; and a spring structure that biases the lock shaft to a position interfering with and preventing rotational movement of said connector pin member relative to said hollow body.

25. The connector pin assembly of claim 24, wherein the locking apparatus further comprises an engagement surface portion associated with and displaceable by rotation of the drive member.

26. The connector pin assembly of claim 25, wherein the engagement surface is configured to engage with and laterally displace the lock shaft against the biasing force of the spring structure associated with and carried by said connector pin member and moveable between a lock position and an unlock position.

* * * * *